US008075213B2

(12) United States Patent
Takada et al.

(10) Patent No.: US 8,075,213 B2
(45) Date of Patent: Dec. 13, 2011

(54) MEDIUM TRANSPORT APPARATUS, PRINTER, PLOTTER AND COMBINATION OF PRINTER AND PLOTTER

(75) Inventors: Masanori Takada, Tomi (JP); Tadanori Ipponyari, Tomi (JP); Eiji Miyashita, Tomi (JP); Tetsuharu Ikeda, Tomi (JP); Akio Kobayashi, Tomi (JP)

(73) Assignee: Mimaki Engineering Co., Ltd., Nagano (JP)

( * ) Notice: Subject to any disclaimer, the term of this patent is extended or adjusted under 35 U.S.C. 154(b) by 930 days.

(21) Appl. No.: 12/056,563

(22) Filed: Mar. 27, 2008

(65) Prior Publication Data

US 2008/0240834 A1 Oct. 2, 2008

(30) Foreign Application Priority Data

Mar. 28, 2007 (JP) ..... 2007-084243

(51) Int. Cl.
*B41J 13/02* (2006.01)

(52) U.S. Cl. ..... 400/636

(58) Field of Classification Search ..... 400/235.1, 400/330.8, 541, 608.1, 617, 429, 641, 330.1, 400/636–636.3, 637–637.8, 638
See application file for complete search history.

(56) References Cited

U.S. PATENT DOCUMENTS 4,283,149 A * 8/1981 Rethmeier ..... 400/617
6,168,260 B1 * 1/2001 Yanagi et al. ..... 347/37

FOREIGN PATENT DOCUMENTS

JP 2006-193303 7/2006

* cited by examiner

*Primary Examiner* — Seung Lee
(74) *Attorney, Agent, or Firm* — Ditthavong Mori & Steiner, P.C.

(57) ABSTRACT

A medium transport apparatus includes a feeding roller configured to rotate around a rotational axis. A guide rail extends along the rotational axis. A slider is supported by the guide rail and movable along the rotational axis. A rotatable pinch roller is configured to clamp medium between the feeding roller and the pinch roller to move the medium. A lever is connected to the pinch roller and movable to change a clamping state with respect to the medium between the feeding roller and the pinch roller. An arm is connected to the slider and configured to take an engaging position where the arm moves the lever to change the clamping state when the slider moves along the rotational axis and a standby position where the arm is not engaged with the lever when the slider moves along the rotational axis.

13 Claims, 13 Drawing Sheets

MEDIUM TRANSPORT APPARATUS, PRINTER, PLOTTER AND COMBINATION OF PRINTER AND PLOTTER

CROSS-REFERENCE TO RELATED APPLICATIONS

The present application claims priority under 35 U.S.C. §119 to Japanese Patent Application No. 2007-084243, filed Mar. 28, 2007. The contents of this application are incorporated herein by reference in their entirety.

BACKGROUND OF THE INVENTION

1. Field of the Invention

The present invention relates to a medium transport apparatus, a printer including the medium transport apparatus, a plotter including the medium transport apparatus, and a combination of a printer and a plotter including the medium transport apparatus.

2. Discussion of the Background

Printer is an apparatus for printing on a surface of a sheet-like medium by, for example, ejecting ink droplets from a printer head while moving the printer head in anteroposterior and lateral directions relative to the sheet-like medium. Plotter (cutting plotter) is an apparatus for conducting the cutting process relative to a sheet-like medium by cutting the sheet-like medium into a predetermined shape with a cutter of a cutting head while moving the cutting head in anteroposterior and lateral directions relative to the sheet-like medium. Both apparatuses are already widely used in the industry. There is also known an apparatus having functions as a printer in addition to a plotter (a plotter with print function).

In these apparatuses, an arrangement called "uniaxial medium movement/uniaxial head movement" or an arrangement called "biaxial head movement" is usually employed as a mechanical arrangement for moving a head such as the printer head or the cutting head relative to the sheet-like medium in the anteroposterior and lateral directions. In the "uniaxial medium movement/uniaxial head movement" arrangement, the printing or cutting process is conducted by rotating the feeding roller and the pinch roller in a state that the sheet-like medium is clamped therebetween so as to feed the sheet-like medium in the anteroposterior direction, and moving the head in the lateral direction along the guide rail disposed in parallel with the feeding roller. In the biaxial head movement" arrangement, the printing or cutting process is conducted by moving the head in the anteroposterior and lateral directions.

In an apparatus having the "uniaxial medium movement/uniaxial head movement" arrangement, an important factor for ensuring the printing quality and cutting quality is that the sheet-like medium clamped between the feeding roller and the pinch roller is fed by a precise feeding amount in proportion to the rotation angle of the feeding roller. For preventing partial slippage and looseness of the sheet-like medium, especially a wide and thin sheet-like medium, roller assemblies each having a rotatable pinch roller are disposed above the feeding roller and are arranged at predetermined intervals in the lateral direction. As an example of such roller assemblies, there is an assembly in which the condition of clamping the sheet-like medium is changeable. For example, the assembly includes a clamp switch mechanism to switch between a clamping position where the pinch roller is pressed against the feeding roller to clamp the sheet-like medium and an unclamping position where the pinch roller is spaced apart from the feeding roller to cancel the clamping of the sheet-like medium. JP-A-2006-193303 discloses such an apparatus. The contents of this publication are incorporated herein by reference in their entirety. Further, another assembly includes a clamping pressure setting mechanism which can vary and set the pressing force (sometimes called as "clamping pressure") of the pinch roller against the feeding roller according to the material and thickness of the sheet-like medium.

However, in the conventional apparatus as mentioned above, an operator operates the appropriate lever whenever the condition of clamping the sheet-like medium is required to be changed. For example, in case that the sheet-like medium is a large leaf (single leaf) sheet-like medium, i.e., that an auto-feeding device such as a sheet feeder is not used, an operator should operate a clamp lever to change the pinch roller from the clamping position to the unclamping position for the purpose of preparing a new sheet-like medium.

In a multifunctional apparatus capable of minutely adjusting the clamping condition according to the material, shape, size, thickness, printing range, and the like of the sheet-like medium, a clamp switch mechanism and a clamping pressure setting mechanism are independently provided for every roller assembly and the clamping pressure can be set to a plurality of stages (for example, three stages such as high, middle, low). Accordingly, in case of processing sheet-like media having different materials, shapes, and/or sizes, it is required to operate the clamp lever and the clamp pressure setting lever of each of the plural roller assemblies for every subject to be processed. Though the multifunction for allowing fine adjustment can be obtained, there is a problem that the setting operation is complex. To solve the problem, there is an idea of providing an arrangement capable of moving the pinch roller and changing the clamping pressure according to an outside signal. However, this arrangement not only makes each roller assembly complex and large but also increases the cost of the entire apparatus and makes the control system complex because this arrangement should be applied to each of the plural roller assemblies.

SUMMARY OF THE INVENTION

According to one aspect of the present invention, a medium transport apparatus includes a feeding roller, a guide rail, a slider, a rotatable pinch roller, a lever and an arm. The feeding roller is configured to rotate around a rotational axis. The guide rail extends along the rotational axis. The slider is supported by the guide rail and movable along the rotational axis. The rotatable pinch roller is configured to clamp medium between the feeding roller and the pinch roller to move the medium. The lever is connected to the pinch roller and movable to change a clamping state with respect to the medium between the feeding roller and the pinch roller. The arm is connected to the slider and configured to take an engaging position where the arm moves the lever to change the clamping state when the slider moves along the rotational axis and a standby position where the arm is not engaged with the lever when the slider moves along the rotational axis.

According to another aspect of the present invention, a printer includes the medium transport apparatus.

According to the other aspect of the present invention, a plotter includes the medium transport apparatus.

According to further aspect of the present invention, a combination of a printer and a plotter includes the medium transport apparatus.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIGS. 9A and 9B show actions of the arm for switching and setting from the state with the OFF state of clamping and the clamping pressure "strong" to the state with the ON state of clamping and the clamping pressure "weak" and show changes in positions of the clamp lever and the clamping pressure setting lever which are moved by the actions in chronological order (1), (2), (3), wherein FIG. 9A is a perspective view thereof and FIG. 9B is a plan view thereof;

DESCRIPTION OF THE EMBODIMENTS

Figure 1:
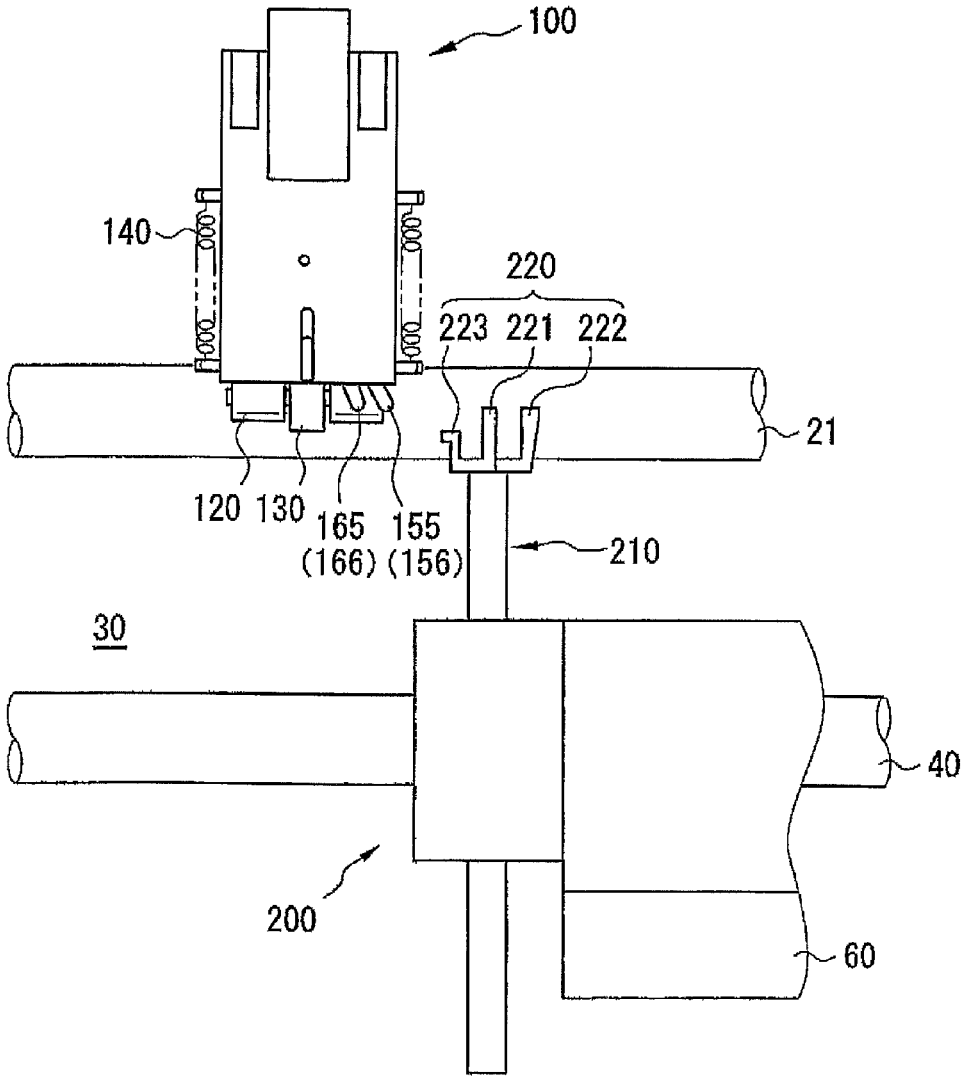
FIG. 1 is a plan view schematically showing the structure of a printer-plotter according to an embodiment of the present invention.

The embodiments will now be described with reference to the accompanying drawings, wherein like reference numerals designate corresponding or identical elements throughout the various drawings. It should be noted that the directions of arrows F, R, U marked in the drawings are forward, rightward, upward in the following description, respectively.

Figure 2:
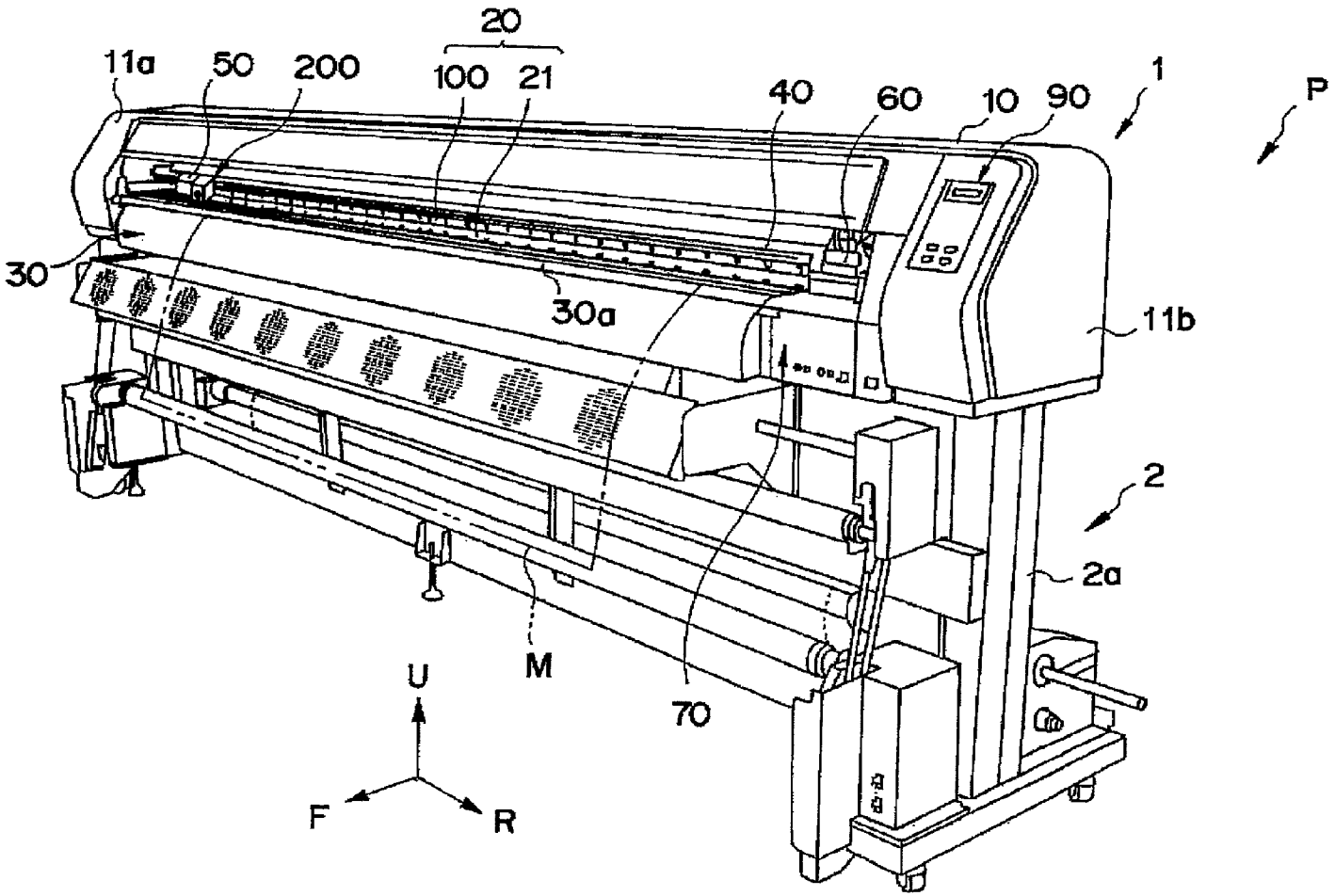
FIG. 2 is a perspective view showing the appearance of a printer-plotter according to an embodiment of the present invention.

Hereinafter, preferred embodiments of the present invention will be described with reference to the attached drawings. As an example of a printer/plotter to which the present invention is applied, a printer-plotter P having functions as a printer in addition to a plotter is shown in FIG. 2 as a perspective view taken obliquely from a front side. With reference to FIG. 2, the entire structure of the printer-plotter will be first described in brief. It should be noted that the directions of arrows F, R, U marked in the FIG. 2 are forward, rightward, upward in the following description, respectively.

A printer-plotter P includes a main unit 1 for conducting a predetermined action such as printing to a sheet-like medium M such as a tarpaulin and a weather-resistant polyvinyl sheet, generally called "media", and a supporting unit 2 having a pair of right and left legs 2*a* by which the main unit 1 is supported. The main unit 1 includes a body 10 fixed to the upper ends of the legs 2*a*, a feeding mechanism 20 for feeding the sheet-like medium M in the anteroposterior direction, a platen 30 for supporting the sheet-like medium M, a guide rail 40 extending in the lateral direction in parallel with the feeding roller above the platen 30, a slider 200 which is supported by the guide rail and is movable along the guide rail in the lateral direction.

Figure 3:
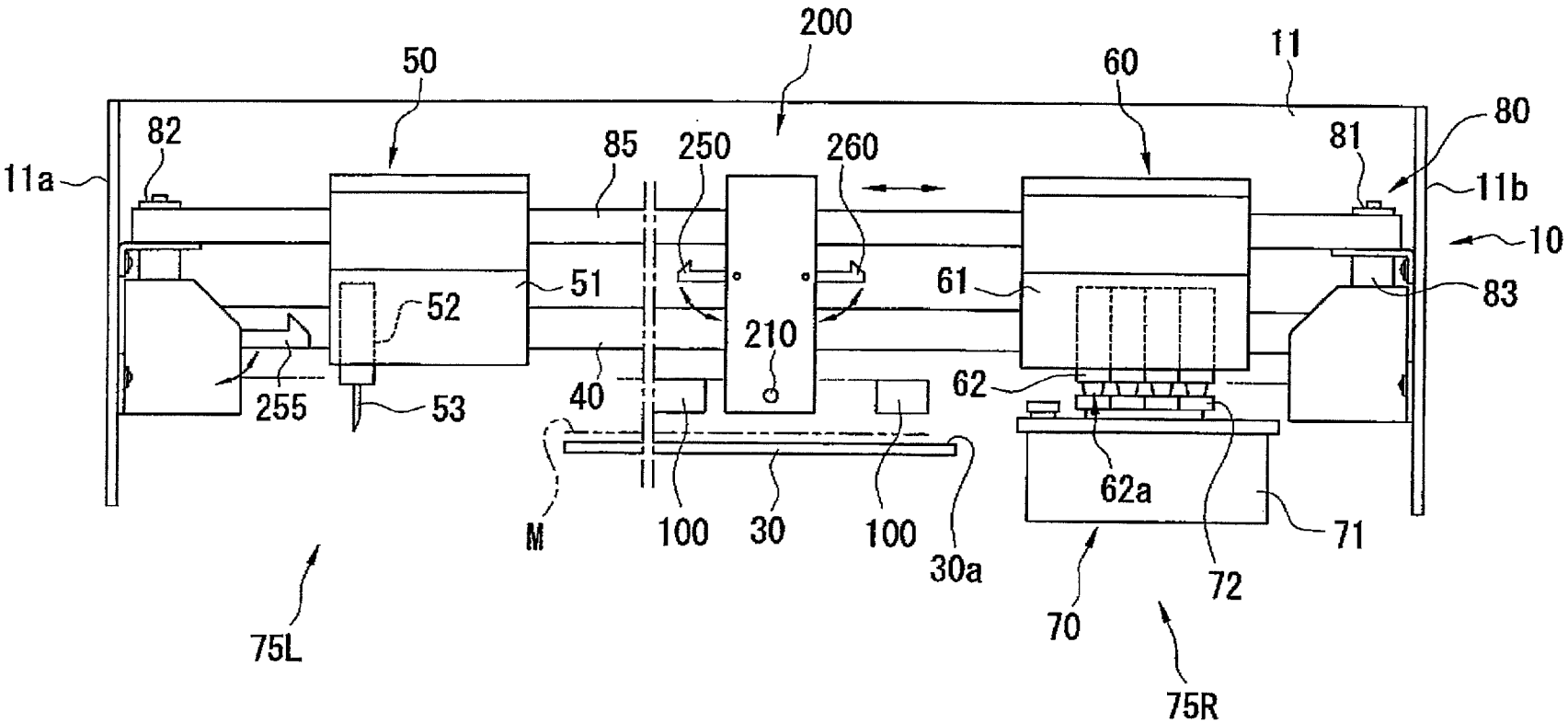
FIG. 3 is an illustration showing a schematic structure inside a cover of the aforementioned printer-plotter.

The body 10 is formed in a horizontally long box-like shape surrounded by a front cover covering the central upper portion and side covers, and includes a gate-like body frame 11 which is provided at the center of the body frame with a medium passage through which the sheet-like medium can pass in the anteroposterior direction. As shown in FIG. 3 illustrating the schematic structure inside the cover, the left and right ends of the guide rail 40 are connected to side walls 11*a*, 11*b* of the body frame so that the guide rail 40 is supported by the side walls 11*a*, 11*b* to extend in the lateral direction between the side walls 11*a* and 11*b*.

The feeding mechanism 20 includes a feeding roller (sometimes called "feed roller") 21 extending in the lateral direction between side walls 11*a* and 11*b* and roller assemblies 100 having rotatable pinch rollers which are aligned in the lateral direction above the feeding roller 21 (the number of the pinch rollers may be from about 10 to about 20 according to the width of the image forming area of the apparatus). The feeding roller 21 is rotated by an electric motor of which operation is controlled by a control unit. In the state where the sheet-like medium M put on the platen 30 is clamped between the feeding roller 21 and the pinch rollers, the feeding roller 21 is rotated, whereby the sheet-like medium M pressed against the feeding roller 21 is fed in the anteroposterior direction by a feeding amount corresponding to the rotation angle of the feeding roller 21. The details of the structure of the roller assembly 100 will be described later.

The platen 30 is positioned between the left and right side walls 11*a* and 11*b* so that the platen 30 is disposed at the center of the body 10, and is provided on its upper surface with a supporting surface 30*a* for horizontally supporting the sheet-like medium M. The supporting surface 30*a* is provided with a number of holes formed therein and a vacuum chamber is formed at the lower surface side of the supporting surface 30*a* such that the vacuum chamber can have a negative pressure. Therefore, the sheet-like medium M is sucked to the supporting surface 30*a* by setting the vacuum chamber to have negative pressure so that the sheet-like medium M can be securely held on the supporting surface during process such as printing process or cutting process. The front end and the rear end of the platen 30 extend downwards through smooth curved surfaces. At a discharge area in front of the platen 30, a heater for heating the sheet-like medium to dry ink just after printed is disposed. Under a paper feed area at the rear end of the platen 30, a roll holder for holding an unprocessed sheet-like medium which is rolled up and a paper feed mechanism for introducing the sheet-like medium onto the platen are disposed. In front of the platen 30, a roll holder for winding up the sheet-like medium after printing and a paper discharge mechanism are disposed.

Disposed on the guide rail 40 are a slider 200 as will be described in detail later, a cutting head 50, and a printer head 60. The cutting head 50 includes a carriage 51 which is supported by and movable along the guide rail 40 in the lateral direction, and a cutter holder 52 attached to the front side of the carriage 51. The cutter holder 52 is supported such that the cutter holder 52 is movable in the vertical direction relative to the carriage 51 by a vertical movement mechanism (not shown) and is rotatable in both the normal and reverse directions about a rotary shaft extending in the vertical direction by a rotation mechanism (also not shown). A cutter 53 can be detachably attached to the cutter holder 52 and has a blade at its lower end for cutting (half cutting, die cutting) the sheet-like medium M. Signal lines are provided to connect the carriage 51 and the body frame 11 to transmit various signals for controlling the operation of the vertical movement mechanism and the rotation mechanism. As an example of the signal lines, a band-like flexible printed wiring having high flexibility is used to be electrically connected to a controller.

The printer head 60 includes a carriage 61 which is supported by and movable along the guide rail 40 in the lateral direction, and a plurality of printer head modules 62 which are disposed on the printing side of the carriage 61 and are aligned in the lateral direction. Each printer head module 62 is provided with a number of ink ejection holes formed in its lower surface in order to allow ejection of fine and thin ink flow so that the printer head modules 62 can eject ink droplets of different colors, respectively. The ink ejection holes of each printer head module 62 face to the supporting surface 30*a* of the platen 30 in the vertical direction so that ink droplets are ejected from the ink ejection holes to the surface of the sheet-like medium M, which is held on the supporting surface 30*a* of the platen 30 by means of suction, so as to conduct intended printing. Connected to the printer head modules 62 are tubes for supplying inks to ink passages from ink storage portions of the cartridge type. Signal lines for supplying electric power and signals for controlling the ink ejection are provided to connect the carriage 61 and the body frame so that the signal lines are electrically connected to the controller, similarly to the aforementioned cutting head 50. The ink storage portions may be mounted on the body 10 or on the carriage 61.

Below a right end portion of the guide rail 40, the body 10 is provided with a maintenance device 70. The maintenance device 70 includes a stage 71 which is movable in the vertical direction and an anti-drying member 72 mounted on the upper surface of the stage 71. The anti-drying member 72 is made of fabric or sponge having moisturizing property. As the printer head 60 is moved to a standby position (R station) 75R at the right end portion of the guide rail 40, the stage 71 is automatically moved upward so that the lower surface of the head module 62 is covered by the anti-drying member 72 to cap the ink ejection holes 62*a*. As the ink ejection holes are capped, the inks around the ink ejection holes are blocked from being exposed to ambient air, thereby preventing the clogging of the ink ejection holes 62*a* due to drying of inks and thus keeping the ink ejection performance well.

A head driving device 80 for moving the heads 50, 60 along the guide rail 40 in the lateral direction is arranged in the body 10. The head driving device 80 includes driving and driven pulleys 81, 82 which are positioned close to the right and left end portions of the guide rail 40, an electric motor 83 for rotating the driving pulley 81, a driving belt 85 composed of an endless belt which is wound around the pulleys 81 and 82 to extend therebetween, and a slider 200 for connecting the cutting head 50 and the printer head 60. The electric motor 83 is composed of, for example, a stepping motor or a servomotor and is adapted to finely control the rotation (rotational direction, rotational velocity, angular position of rotation) of the driving pulley 81. The driving belt 85 is a synchronous toothed belt having a number of teeth formed in its inner periphery and the pulleys 81, 82 are both synchronous toothed pulleys so that the rotation of the electric motor 83 is transmitted to the driving belt 85 without slippage, thereby controlling the movement of the driving belt in the lateral direction as shown by arrows in FIG. 3 (in the clockwise direction and the counterclockwise direction in its plan view).

The cutting head 50 and the printer head 60 are supported by the guide rail 40 such that the heads 50, 60 are movable in the lateral direction, respectively. To enable the respective heads 50, 60 to be controlled to travel in the lateral direction together, one of the heads, the printer had 60 in this embodiment, is connected to the driving belt 85 and is therefore moved always together with the driving belt 85. On the other hand, the cutting head 50 is moved together with the printer head 60 when the cutting head 50 is connected to the printer head 60 by the slider 200 which is supported by the guide rail 40 such that the slider 200 can slide along the guide rail 40 in the lateral direction.

That is, the slider 200 is provided with connecting hooks 250, 260 which project leftward and rightward and are pivotally movable in the vertical directions, as shown in FIG. 3. The left and light hooks are pivotally moved by solenoids embedded in the slider 200 independently from each other. On the other hand, the cutting head 50 is provided with an L hook receiving portion which receives the left-side connecting hook 250 so that the cutting head 50 can be attached to and detached from the slider 200 by the operation of the built-in solenoid. The printer head 60 is provided with an R hook receiving portion which receives the right-side connecting hook 260 so that the printer head can be attached to and detached from the slider 200 by the operation of the built-in solenoid.

In addition, a retaining hook 255 which is pivotally movable in the vertical direction is disposed to be positioned at the left end side of the guide rail 40 and is pivotally moved by a built-in solenoid. The cutting head 50 is provided with a retaining hook receiving portion which receives the retaining hook 255 to engage with the retaining hook 255 so that the cutting head 50 (and the slider 200 connected to the cutting head 50) can be retained at a standby position (L station) 75 at the left end side of the guide rail and can be moved in the lateral direction together with the printer head 60 when connected to the printer head 60 by the slider 200.

In the printer-plotter P, therefore, only the printer head 60 can be moved in the lateral direction by the driving mechanism 80 to conduct the printing process relative to the upper surface of the sheet-like medium M in the state where the cutting head 50 is retained by the left-side L station 75L by the retaining hook 255 and the slider 200 is connected to the cutting head 50 by the left-side connecting hook 250 and is thus retained by the L station 75L together with the cutting head 50. In addition, the slider can be moved in the state where the slider 200 is connected to the printer head 60, and the cutting head 50 can be moved to conduct the cutting process in the state where the slider 200 and the cutting head 50 are connected to the printer head 60.

In the right-side cover of the body 10, a controller 90 is disposed to control the operations of the respective components of the printer-plotter P. The controller 90 is adapted to control the operations of the respective components such as the feeding mechanism 20, the cutting head 50, the printer head 60, the head driving device 80, and the slider 200 based on control programs which are previously stored in the printer-plotter P and process programs which are read according to the subject to be processed. As the process relative to the sheet-like medium M is started with the controller 90, the printing or cutting process according to the process program is conducted.

Figure 4:
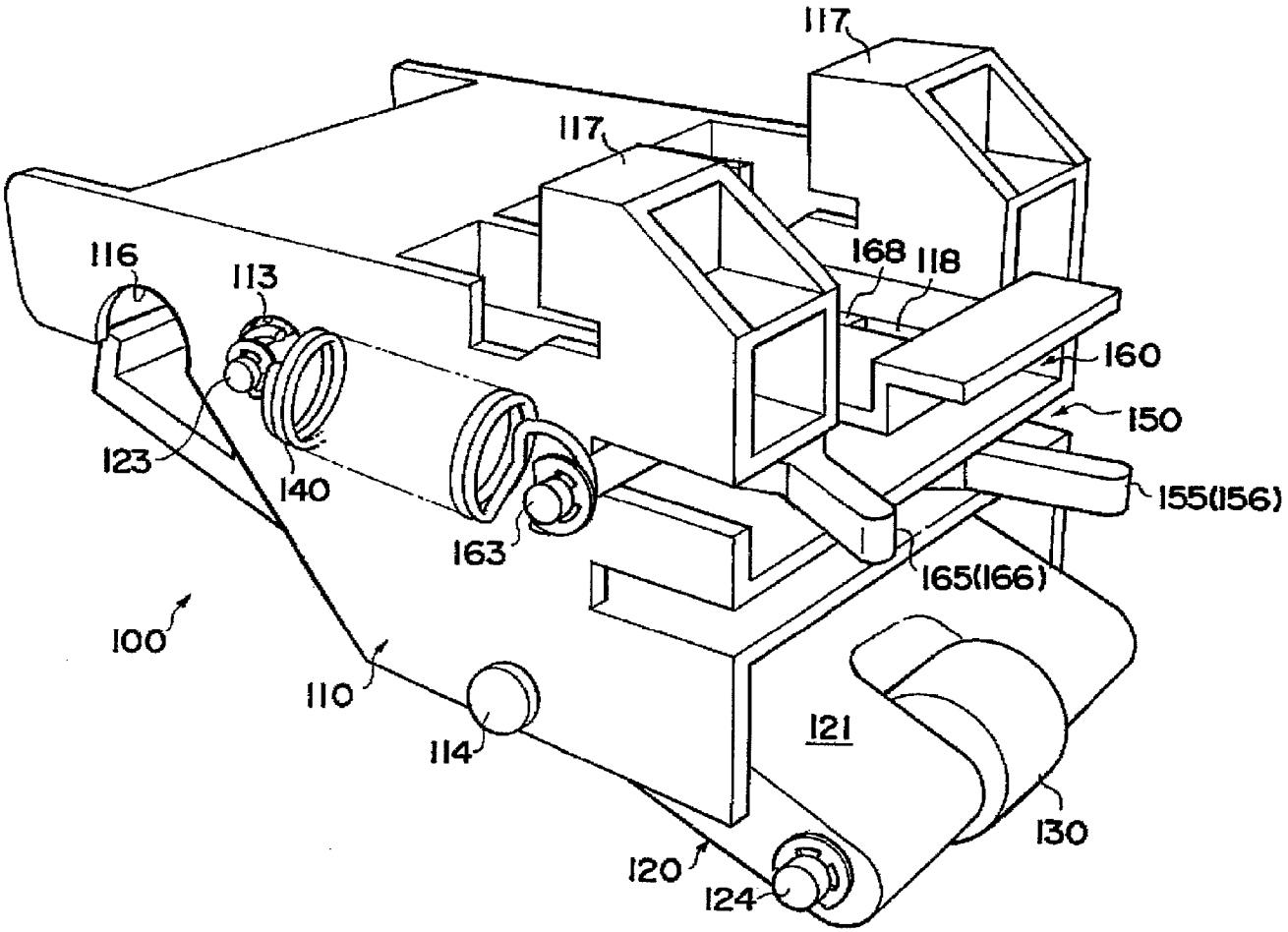
FIG. 4 is a perspective view showing the appearance of a roller assembly used in the aforementioned printer-plotter.
Figure 5:
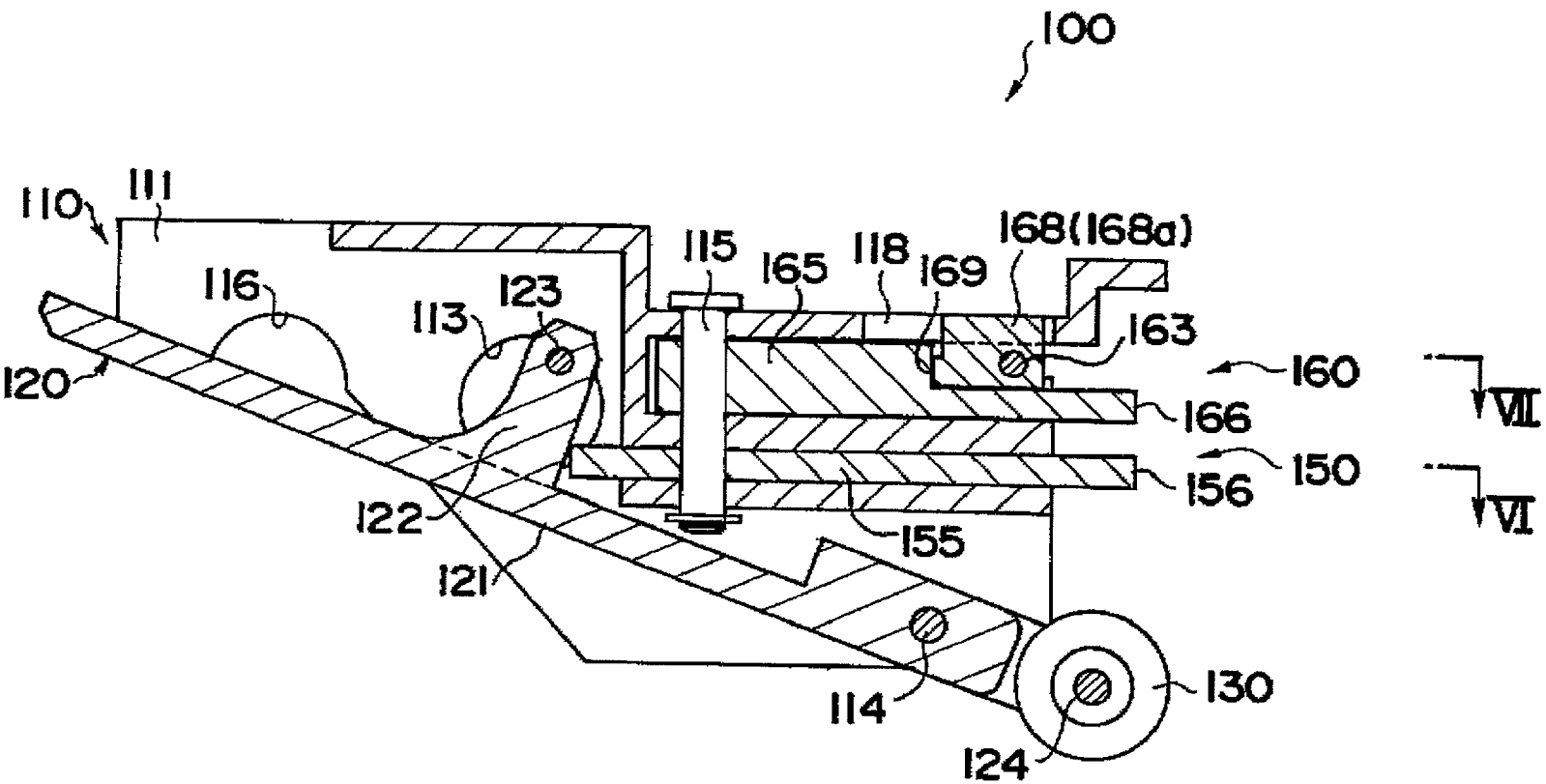
FIG. 5 is a side sectional view of the aforementioned roller assembly.

In the printer-plotter P having the structure roughly described above, the roller assembly 100, of which external view is shown in FIG. 4 and a side sectional view taken along the center in the lateral direction is shown in FIG. 5, includes an assembly casing 110 as a frame of the assembly, a clamp base 120 which is supported such that the clamp base 120 is pivotally movable in the vertical direction about a pivot shaft 114 extending in the lateral direction in a lower portion of the assembly casing 110, a pinch roller 130 which is rotatably supported by a roller pin 124 at the front end of the clamp base 120, a pair of left and right coil springs 140 one ends of which are hooked and fixed to a spring supporting shaft 123 of the clamp base side and the other ends of which are hooked and fixed to a spring supporting shaft 163 of the assembly casing side so as to bias the clamp base 120, supported by the pivot shaft 114, in the clockwise direction as seen in FIG. 5 (a direction of moving the pinch roller 130 downward), a clamp switch mechanism 150 which has a lever 155 projecting forward from the assembly casing 110 to switch the state of clamping by the roller assembly between the ON state of clamping (the state clamped by the roller assembly) and the OFF state of clamping (the state not clamped by the roller assembly) and a clamping pressure setting mechanism 160 which has a lever 160 projecting forward from the assembly casing 110 to change the clamping pressure.

As shown in FIG. 5, the assembly casing 110 has a front-side portion which is separated into three stages by walls. The lever (sometimes referred to as "clamp lever") 155 of the clamp switch mechanism 150 in a middle stage and the lever (sometimes referred to as "clamping pressure setting lever") 165 of the clamping pressure setting mechanism 160 in an upper stage are held by a lever shaft 115 extending in the vertical direction such that the levers 150, 160 are pivotally movable independently in the lateral direction. At a rear portion of the assembly casing 110, a shaft engaging portion 116 which is engaged with a supporting shaft for supporting the roller assembly is formed. At an upper portion of the front-side portion of the casing, left and right fixing flanges 117 having threaded holes formed therein are formed at two positions in the lateral direction.

The clamp base 120 includes a flat base plate 121 which is supported by the pivot pin 114, mounted to connect the left and right side walls of the assembly casing 110, such that the flat base plate 121 is pivotally movable and which extends in the anteroposterior direction, a lever engaging portion 122 like a wall which projects from the base plate 121 and extends in parallel with the pivot shaft 114, and the spring supporting shaft 123 axially supported and inserted into a shaft hole formed in an upper end portion of the lever engaging portion 122 to penetrate through the lever engaging portion 122 in the lateral direction. Formed in the left and right side walls of the assembly casing 110 are shaft through openings 113 through which the spring supporting shaft 123 passes. The shaft through openings 113 are formed into a shape corresponding to the rocking trajectory of the spring supporting shaft 123. The spring supporting shaft 123 is arranged such that the left and right end portions thereof project outward from the assembly casing 110. E-rings are fitted onto the left and right end portions of the spring supporting shaft 123 so that the coil springs 140 hooked and fixed to the spring supporting shaft 123 are prevented from easily coming off from the spring supporting shaft 123.

The other ends of the coil springs 140 are hooked and fixed to the spring supporting shaft 163 which is inserted through a cam slider 168 of the clamping pressure setting mechanism 160. Therefore, the spring supporting shaft 123 is pulled by spring force (tension) according to the distance between the spring supporting shaft 123 of the clamp base side and the spring supporting shaft 163 of the assembly casing side, whereby the clamp base 120 supported by the pivot shaft 114 is biased in the clockwise direction as seen in FIG. 5 (in the direction of moving the pinch roller 130 downward). E-rings are also fitted onto the left and right end portions of the spring supporting shaft 163 so that the coil springs 140 hooked and fixed to the spring supporting shaft 163 are prevented from easily coming off from the spring supporting shaft 163.

As for the clamp base 120 disposed and biased as mentioned above, the clamp switch mechanism 150 is a mechanism for setting the state of clamping whereby the position of the roller assembly 100 can be switched between a clamping position (ON state of clamping) where the pinch roller 130 is pressed against feeding roller 21 to clamp the sheet-like medium M therebetween and an unclamping position (OFF state of clamping) where the pinch roller 130 is upwardly spaced apart from the feeding roller 21 to cancel the clamping of the sheet-like medium M.

Figure 6A:
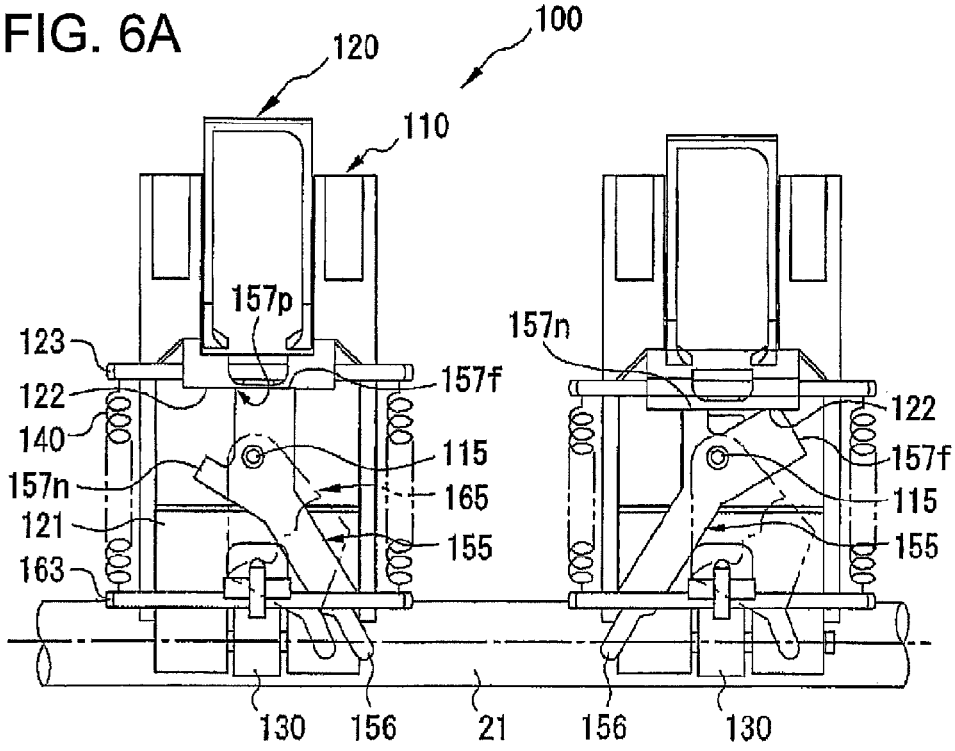
FIGS. 6A and 6B are illustrations for explaining the structure and the works of the clamp switch mechanism disposed on the roller assembly.
Figure 6B:
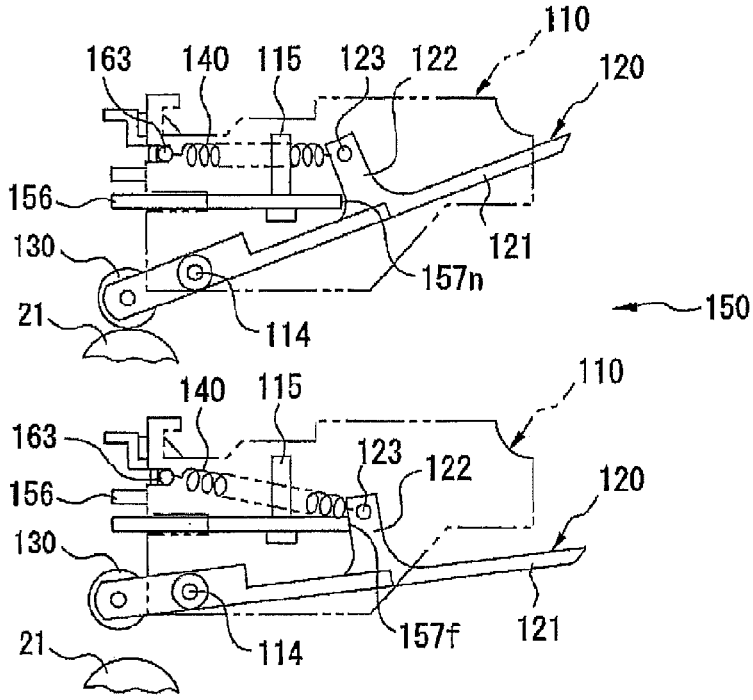

For explaining the structure and operation of the clamp switch mechanism 150, FIGS. 6A, 6B show the ON state of clamping where the roller assembly 100 is set to the clamping position by moving the clamp lever 155 to have the left end angular position and the OFF state of clamping where the roller assembly 100 is set to the unclamping position by moving the clamp lever 155 to have the right end angular position. FIG. 6A is a plan view taken along an arrow VI in FIG. 5 and FIG. 6B is a side view taken from the right side. It should be noted that some components and structure such as the clamp casing 110 and the clamping pressure setting mechanism 160 are suitably omitted in the respective drawings for clearly showing the relation between the angular position of the clamp lever 155 and the angular position of the clamp base 120 which is moved according to the angular position of the clamp lever 155. The clamp switch mechanism 150 is mainly composed of the lever engaging portion 122 of the clamp base 120 and the clamp lever 155.

The clamp lever 155 has a rod-like shape extending in the anteroposterior direction across the lever shaft 115 and is held to the clamp casing 110 such that the clamp lever 155 is pivotally movable in the lateral direction about the lever shaft 115. The front end-side portion of the clamp lever 155 extending forward from the lever shaft 115 is positioned above the pinch roller 130 and projects forward from the clamp casing 110 so as to form a lever portion 156 which can be operated by a finger. The rear end-side portion of the clamp lever 155 is formed into a cam shape (Y-like cam shape in the embodiment illustrated) to have, on its right side, an OFF contact face 157*f* at a larger radial distance from the lever shaft 115 and, on its left side, an ON contact face 157*n* at a smaller radial distance from the lever shaft 115.

When the clamp lever 155 is set to the right end angular position as the OFF position, the OFF contact face 157*f* is in contact with the lever engaging portion 122 of the clamp base 120 to press the lever engaging portion 122 backward against the biasing force of the coil springs 140 so that the pinch roller 130 at the front end of the clamp base is held at the unclamping position (OFF state of clamping) upwardly spaced apart from the feeding roller 21. When the clamp lever 155 is set to the left end angular position as the ON position, the ON contact face 157*n* (and a left end corner 157*p* of the OFF contact face 157*f*) are contact with the lever engaging portion 122 so that the pinch roller 130 is held at the clamping position (the ON state of clamping) where the pinch roller 130 is pressed against the peripheral surface (upper surface) of the feeding roller 21 by the biasing force of the coil springs 140.

That is, the angular position of the clamp lever 155 when the left end corner 157*p* of the OFF contact face 157*f* is positioned on a normal line extending from the lever shaft 115 to the lever engaging portion (hereinafter, referred to as "ON/OFF switching angle") is the boundary for switching. As the clamp lever 155 is positioned on a left side of the ON/OFF switching angle, the clamp lever 155 is pivotally moved to the ON position by the biasing force of the coil springs 140 whereby the roller assembly is set to the clamping position. As the clamp lever 155 is positioned on a right side of the ON/OFF switching angle, the clamp lever 155 is pivotally moved to the OFF position whereby the roller assembly is set to the unclamping position.

As can be clear from FIG. 6A, the OFF contact face 157*f* is formed to have a left end side which is shorter relative to the normal line extending from the lever shaft 115 to the OFF contact face 157*f* (that is, an angle between the normal line and a straight line extending from the lever shaft 115 to the left end corner 157*p* is small) so that the ON/OFF switching angle is set to an angular position where is slightly shifted leftward from the right end angular position as the OFF position of clamping. In the clamp switch mechanism 150, therefore, the roller assembly 100 is switched from the unclamping position to the clamping position just by slightly moving the clamp lever 155 leftward from the OFF position (paradoxically speaking, the roller assembly is not switched to the unclamping position unless the clamp lever 155 is moved to the OFF position completely).

The ON contact face 157*n* is formed such that the ON contact face 157*n* comes in contact with the lever engaging portion 122 when the clamp lever 155 is set to the ON position in the case where the roller assembly stands alone (i.e. without the feeding roller 21), but the pinch roller 130 comes in contact with the feeding roller 21 at an angular position before the ON contact face 157*n* comes in contact with the lever engaging portion 122 and is then pressed with biasing force preset by the clamping pressure setting mechanism 160 as will be described in the following and the ON contact face 157*n* is slightly spaced apart from the lever engaging portion 122 when the clamp lever 155 is set to the ON position in the case where the roller assembly 100 is assembled to the printer-plotter P.

The clamping pressure setting mechanism 160 is a mechanism for setting the state of clamping by changing the force of pressing the pinch roller 130 when the roller assembly is set to the clamping position where the pinch roller 130 is pressed against the feeding roller 21 to clamp the sheet-like medium M.

Figure 7A:
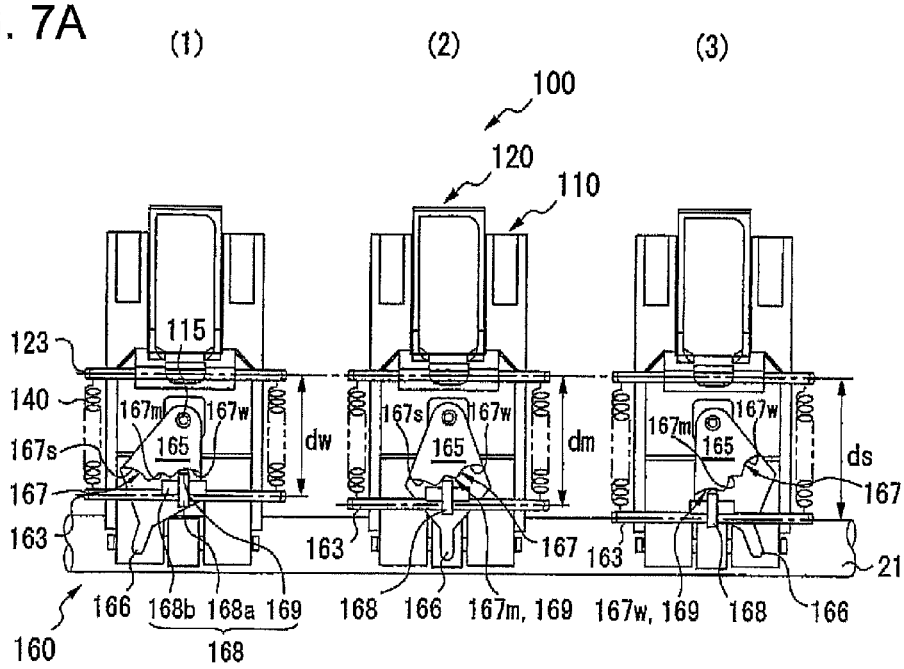
FIGS. 7A and 7B are illustrations for explaining the structure and the works of the clamping pressure setting mechanism disposed on the roller assembly.
Figure 7B:
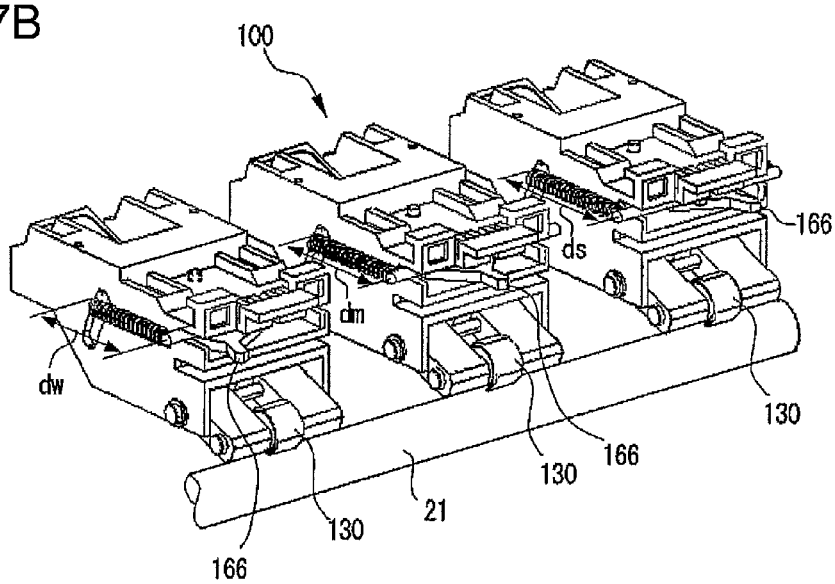

For explaining the structure and the action of the clamping pressure setting mechanism 160, FIGS. 7A, 7B show the relations between the state of the clamping pressure setting lever 165 and the state of the coil springs 140 when the clamping pressure setting mechanism 160 is set to either of three stages, i.e. weak, medium, and strong. FIG. 7A is a plan view taken along an arrow VII in FIG. 5 and FIG. 7B is a perspective view of the roller assembly. It should be noted that, also in these drawings, some components and structure such as the clamp casing 110 and the clamp switch mechanism 150 are suitably omitted for clearly showing the relation between the angular position of the clamping pressure lever 165 and the position of the spring supporting shaft 163 which is moved according to the angular position of the clamping pressure lever 165.

The clamping pressure setting lever 165 has a rhombic shape which spreads out in a fan-like form forward from the lever shaft 115 and then narrows in a taper form as seen from above. The clamping pressure setting lever 165 is positioned above the clamp lever 155 of the clamp switch mechanism and is held such that the clamping pressure setting lever 165 is pivotally movable in the lateral direction about the lever shaft 115. The front end-side portion of the clamping pressure setting lever 165 projects forward from the clamp casing 110 so as to form a lever portion 166 which can be operated by a finger. The distal end-side portion of the clamping pressure setting lever 165 is formed to have a thickness larger than that of the lever portion 166 so that there is a step therebetween. In the riser face of the step, a cam surface 167 in a waveform as seen from above is formed. The cam surface 167 includes three engaging concavities to which an engaging convexity 169 as the tip end of the cam slider 168 can be fitted to stop the cam slider 168 and which are, in order from the right, a weak engaging concavity 167*w* having a small radial distance from the lever shaft 115, a medium engaging concavity 167*m* having a middle radial distance from the lever shaft 115, and a strong engaging concavity 167*s* having a large radial distance from the lever shaft 115.

The cam slider 168 to be engaged with the cam surface 167 includes a body portion 168*a* having a rectangular shape, as seen in its sectional view, of which anteroposterior length is longer, and a supporting portion 168*b* which projects leftward and rightward from the body portion 168*a* and is supported between the upper surface of the camping pressure setting lever and the camp casing. The spring supporting shaft 163 is inserted through a shaft through hole penetrating the body portion 168*a* in the lateral direction (see FIG. 5). The camp casing 110 is provided with supporting shaft through grooves which are formed in the left and right side walls to open forward for receiving the insertion of the spring supporting shaft 163. The cam casing 110 is also provided with a slit-like slide groove 118 corresponding to the width of the body portion 168*a* of the cam slider 168. An upper portion of the body portion is fitted in the slide groove 118 so as to allow the sliding displacement of the cam slider 168 only in the anteroposterior direction between the upper surface of the clamping pressure setting lever 165 and the upper wall of the clamp casing 110. The cam slider 168 is always biased backward by spring force of the coil springs 140 held between the spring supporting shafts 123 and the 163 (see FIG. 4 and FIG. 5). The body portion 168 is provided at the rear end with an engaging convexity 169 having an arc shape as seen from above. The engaging convexity 169 is in contact with the cam surface 167 and can be suitably supported by one of the three engaging concavities 167*w*, 167*m*, and 167*s* formed in the cam surface.

As the clamping pressure setting lever 165 is moved in the lateral direction against the spring force of the coil springs 140, the engaging convexity 169 being contact with the cam surface 167 of the clamping pressure setting lever slides on the cam surface so as to displace and can hold the clamping pressure setting lever 165 at an angular position where the engaging convexity 169 is engaged with any one of the three engaging concavities 167*w*, 167*m*, and 167*s*.

The three engaging concavities 167*w*, 167*m*, 167*s* have different radial distances from the lever shaft 115, respectively as mentioned above. The radial distances are set such that the weak engaging concavity 167*w*<the medium engaging concavity 167*m*<the strong engaging concavity 167*s*. The position of the spring supporting shaft 163 when the engaging convexity 169 is fitted in either of the engaging concavities varies in the anteroposterior direction so as to change the setting length "d" of the coil springs 140 held between the spring supporting shafts 123 and 163. That is, assuming that the setting length when the clamping pressure setting lever 165 is moved leftward to fit the engaging convexity 169 in the weak engaging concavity 167*w* is "dw", the setting length when the clamping pressure setting lever 165 is positioned at the middle to fit the engaging convexity 169 in the medium engaging concavity 167*m* is "dm", and the setting length when the clamping pressure setting lever 165 is moved rightward to fit the engaging convexity 169 in the strong engaging concavity 167*s* is "ds", an expression "dw<dm<ds" is established. Therefore, the spring force corresponding to the setting length, that is, the pressing force (clamping force) of pressing the pinch roller 130 to the feeding roller 21 corresponding to the setting length can vary among three stages, i.e. weak, medium, and strong.

In the clamping pressure setting mechanism 160, the engaging convexity 169 can be changed to be fitted into either of the engaging concavities 167*w*, 167*m*, and 167*s* so as to change the setting of the clamping pressure among weak, medium, and strong by moving the clamping pressure setting lever 165 in the lateral direction. For simplifying the following description, the angular position of the clamping pressure setting lever 165 will be referred to as "weak position" when the engaging convexity 169 is fitted in the weak engaging concavity 167*w*, the angular position of the clamping setting lever will be referred to as "medium position" when the engaging convexity 169 is fitted in the medium engaging concavity 167*w*, and the angular position of the clamping pressure setting lever 165 will be referred to as "strong position" when the engaging convexity 169 is fitted in the strong engaging concavity 167*s*.

The angular range from the weak position to the strong position of the clamping pressure setting lever 165 is smaller than the angular range from the OFF position to the ON position of the clamp lever 155 because the cam surface expands beyond the respective centers of the weak engaging concavity 167*w* and the strong engaging concavity 167*s*. Therefore, at the moving ends of the both levers, the length from the lever shaft 115 to the end of the lever portion 166 of the clamping pressure setting lever 165 is slightly smaller than the length from the lever shaft 115 to the end of the lever portion 156 of the clamp lever 155 such that the front end positions of the lever portions 156, 166 are substantially equal to each other (see FIG. 6 and FIG. 9 through FIG. 13 as will be described later).

As apparent from the above description, the clamping mechanism 150 and the clamping pressure setting mechanism 160 have different setting mechanisms so that the ON/OFF state of clamping and the intensity, i.e. weak/medium/strong of the clamping pressure can be independently set by operating the respective levers 155, 165.

In front of the roller assembly 100, the slider is supported by the guide rail 40 such that the slider can move in the lateral direction and an arm which can be contact with the clamp lever 155 and the clamping pressure setting lever 165 is detachably attached to the slider. FIG. 1 is a plan view, taken from above of the platen 30, schematically showing the positional relation among the roller assembly 100, the slider 200, and the arm 210 attached to the slider 200.

The arm 210 has a shaft-like shape extending in the anteroposterior direction to penetrate the slider 200 and can be moved in the anteroposterior direction between an engaging position (where the end of the arm 210 is protracted as shown in FIG. 1) and a retracting position (where the end of the arm 210 is retracted toward the slider 200) by an arm driving mechanism built in the slider 200. At the engaging position, the end of the arm comes in contact with the clamp lever 155 and the clamping pressure setting lever 165 so as to move the respective levers by moving the slider 200 along the guide rail 40 in the lateral direction. At the retracting position, the arm is not contact with any one of the levers 155, 165 so as to pass through the roller assembly 100. That is, the arm 210 is positioned at substantially the same level as the levels of the levers 155, 165 in front of the roller assembly 100 so as to come in contact with the levers 155, 165 and can be displaced to be protracted and retracted in the anteroposterior direction from the slider 200 which moves in the lateral direction in the state connected to the printer head 60.

The detail description of the arm driving mechanism for moving the arm 210 in the anteroposterior direction will be omitted. However, various known driving arrangements may be used for the arm driving mechanism, for example, an actuator such as a direct-operated solenoid and an air cylinder is embedded in the arm 210 to directly drive the arm 210, and an actuator such as a direct-operated solenoid, a rotary solenoid, and an electric motor via a linkage mechanism or a cam mechanism to indirectly drive the arm 210. As the structure for stopping the arm at the engaging position and the retracting position, various known positioning arrangements may be used, for example, a ring-like collar is fixed to the arm positioned within the slider and positioning stoppers are arranged in the slider at positions before and after the collar corresponding to the engaging position and the retracting position.

Figure 8:
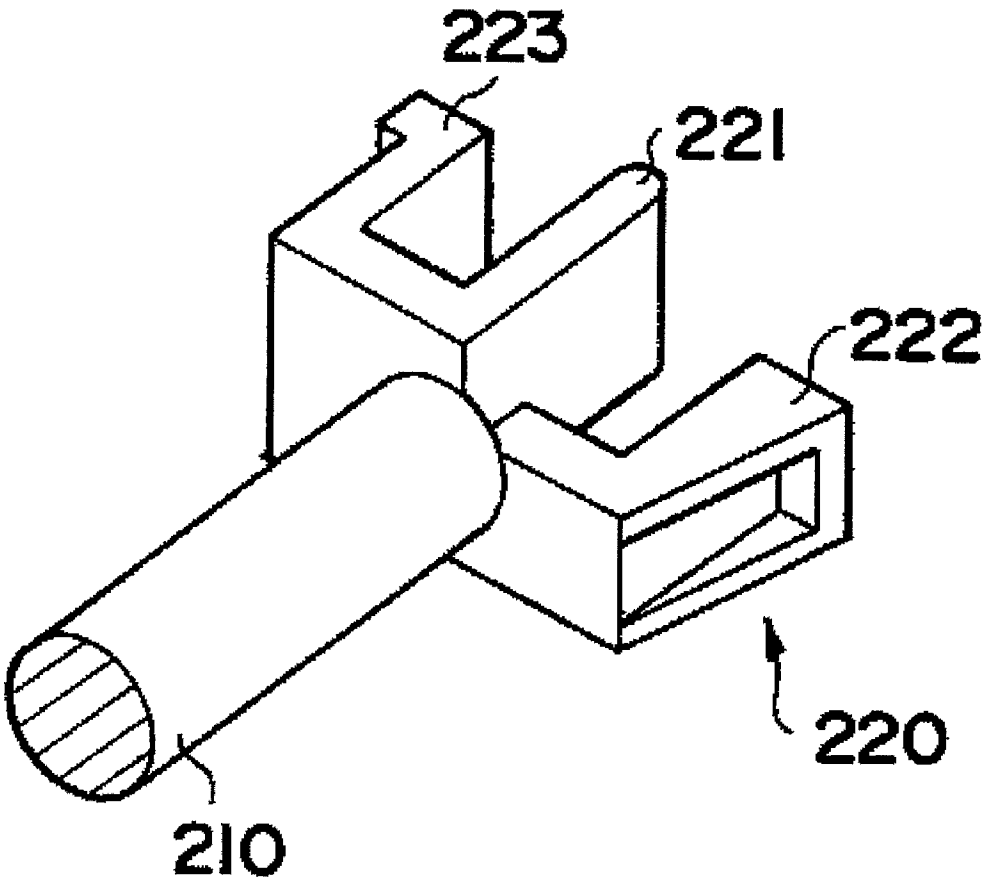
FIG. 8 is an enlarged perspective view showing an end of an arm.

At the end of the arm 210 which is movable in the anteroposterior direction, an engaging hand 220 to be in contact with the levers 155, 165 is formed. As shown in FIG. 8 as an enlarged perspective view showing the end of the arm 210 illustrated in FIG. 1, the engaging hand 220 includes a first engaging finger 221 which is formed to extend in an axial line on the arm 210 and is positioned at the center, a second engaging finger 222 which is formed on the right side of the first engaging finger 221, and a third engaging finger 223 which is formed on the left side of the first engaging finger 221. The first engaging finger 221, the second engaging finger 222, and the third engaging finger 223 are formed to have certain spaces decided taking into consideration the engaging angles of the levers 155, 165 (certain spaces not to cause interference when the levers are positioned on the left end side or the right end side).

The first engaging finger 221 positioned at the center is formed in a vertical plate shape having parallel left and right walls and having such a height capable of coming into contact with both of the clamp lever 155 and the clamping pressure setting lever 165 to pivotally move the levers 155, 165 leftward or rightward. On the other hand, the second engaging finger 222 on the right side of the first engaging finger 221 is formed at a lower position to have a height smaller than that of the first engaging lever such that the second engaging finger 222 comes in contact with the clamp lever 155 to pivotally move the clam lever 155 but does not come in contact with the clamping pressure setting lever 165. The third engaging finger 223 on the left side of the first engaging finger 221 is formed to have the same height as that of the first engaging finger 221 and have a length projecting forward smaller than that of the first engaging finger 221 such that the third engaging finger 223 does not come in contact with the clamping pressure setting lever 165 but comes in contact with the clamp lever 155 when the clamp lever 155 is positioned at a middle area (left and right areas about the medium position of the clamping pressure setting lever 165) on the pivotal movement trajectory thereof and does not come in contact with the clamp lever 155 when the clamp lever 155 is positioned in the left or right area. For example, when the clamp lever 155 is moved leftward beyond the middle area, the clamp lever 155 is released from the third engaging finger 223 and the clamp lever 155 is moved to the ON position by the spring force of the coil springs 140 (see FIGS. 9(1), 9(2)).

The actions of the slider 200 and the arm 210, that is, the action of the head driving device 80 for moving the slider 200 in the lateral direction in the state that the slider 200 is connected to the printer head 60 by the connecting hook 260 and the anteroposterior movement of the arm 210 by the arm driving mechanism are controlled by the controller 90 as mentioned above.

Figure 9A:
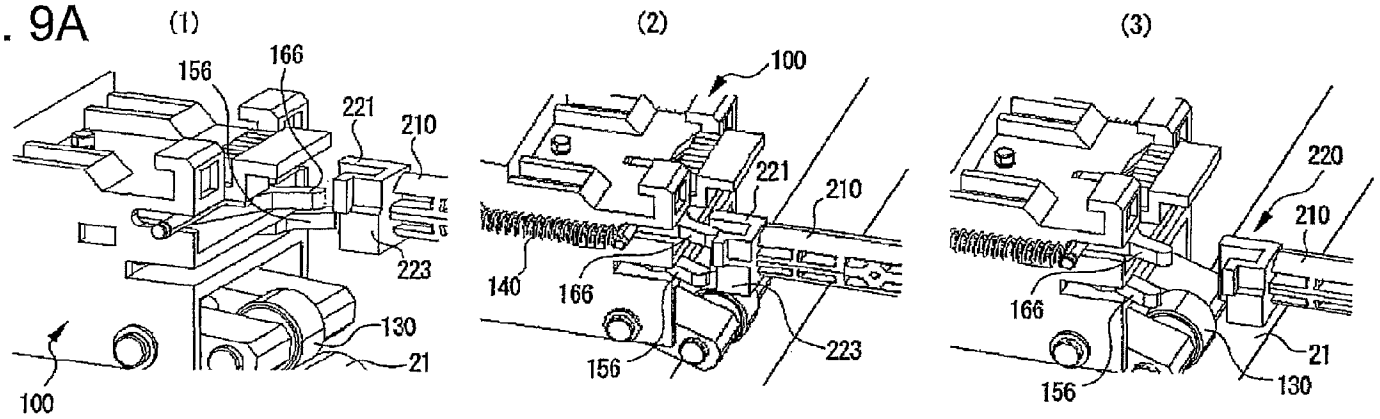
Figure 9B:
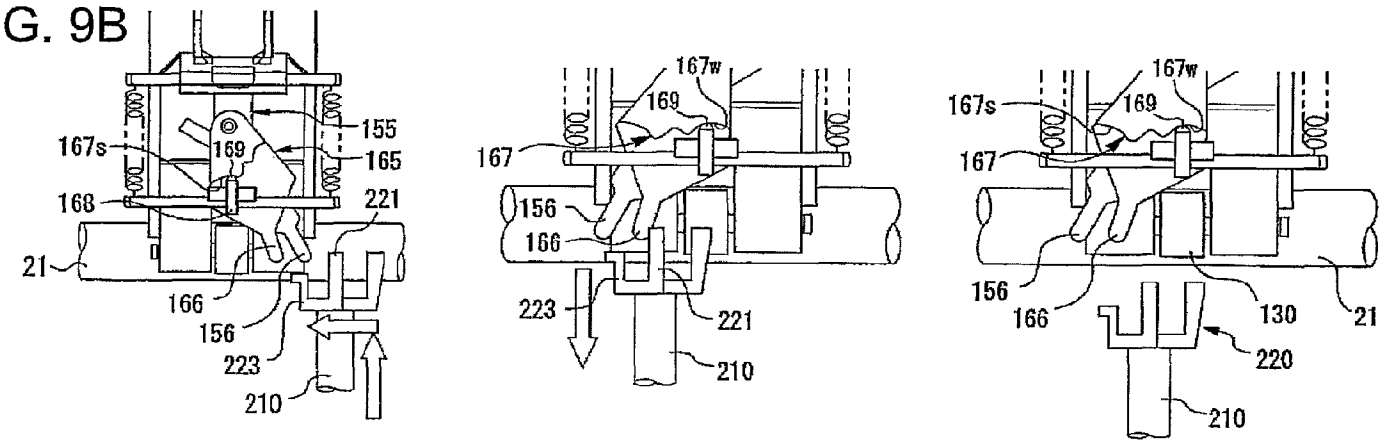

As to the operation by the slider 200 and the arm 210 having the aforementioned structures for setting the state of clamping (ON/OFF state of the clamping and the intensity i.e. weak/medium/strong of the clamping pressure), five basic actions will be described sequentially with reference to FIGS. 9A, 9B through FIGS. 13A, 13B. FIGS. 9A, 9B show actions of the arm 210 for switching and setting from the standby state with the OFF state of clamping and the clamping pressure "strong" for introducing or feeding out the sheet-like medium to the reference state with the ON state of clamping and the clamping pressure "weak" and show changes in positions of the clamp lever 155 and the clamping pressure setting lever 165 which are moved by the actions in chronological order (1), (2), (3). FIG. 9A is a perspective view thereof and FIG. 9B is a plan view thereof.

As to the roller assembly 100, a plurality of the same roller assemblies are disposed above the platen 30 and are aligned in the lateral direction. According to the thickness (including a case having partially different thicknesses), the size, and the shape of the sheet-like medium M which are set in the controller 90, the setting change for switching the state of clamping is conducted sequentially relative to the roller assemblies in a corresponding range. However, the following description will be made with reference to one of the roller assemblies because the description will be repetition or combination of the switching action for every the roller assembly.

(1) In the standby state with the OFF state of clamping and the clamping pressure "strong", the clamp lever 155 is positioned at the right end angular position as the OFF position and the clamping pressure setting lever 165 is also at the right end angular position as the strong position. The controller 90 moves the slider 200 to such a position that the first engaging finger 221 at the arm end is on the right side of the lever portion 156 of the clamp lever and protracts the arm 210 to the engaging position. In this state, the controller 90 moves the slider 200 leftward. Then, the left wall of the first engaging finger 221 comes in contact with the lever portions 156, 166 of the clamp lever 155 and the clamping pressure setting lever 165 so as to pivotally move the levers 155, 165 leftward (in the clockwise direction as seen from above).

(2) The controller 90 moves the slider 200 leftward to a weak-position corresponding position (a position in the lateral direction corresponding to the weak position of the clamping pressure setting lever 165). During this, the clamp lever 155 is pivotally moved leftward by the spring force of the coil springs 140 after the clamp lever 155 passes through the ON/OFF switching angle. In the middle area on the pivotal movement trajectory of the lever 155, the end of the lever portion 156 comes in contact with the third engaging finger 223 and is held by the third engaging finger 223. When the slider is moved to the vicinity of the weak-position corresponding position, the end of the lever portion 156 is released from the third engaging finger 223 and is pivotally moved to the ON position so that the roller assembly is set to the clamping position where the pinch roller 130 is pressed against the feeding roller 21. That is, such an arrangement that the lever 156 is received and held by the third engaging finger 223 reduces the pivotal moving angle of the clamp base 120 which is pivotally moved by the spring force of the coil springs, thereby preventing the pinch roller 130 from violently colliding with the feeding roller 21. On the other hand, in the clamping pressure setting mechanism 160, the cam slider 168 slides along the cam surface 167 to move backward (in a direction apart from the arm 210) according to the leftward pivotal movement of the clamping pressure setting lever 165. When the slider 200 reaches the weak-position corresponding position, the engaging convexity 169 of the cam slider is fitted in the weak engaging concavity 167*w* of the cam surface.

(3) In this weak-position corresponding position, the arm 210 is moved to the retracting position. Therefore, the clamp switch mechanism 150 is switched from the unclamping position to the clamping position (from the OFF state to the ON state of clamping) and the clamping pressure setting mechanism 160 is set to the reference state in which the pressing force of the pinch roller 130 is switched from "strong" to the "weak" (from the clamping pressure "strong" to "weak") so that the sheet-like medium (not shown) is clamped between the feeding roller 21 and the pinch roller 130 with a clamping pressure which is set at "weak".

Figure 10A:
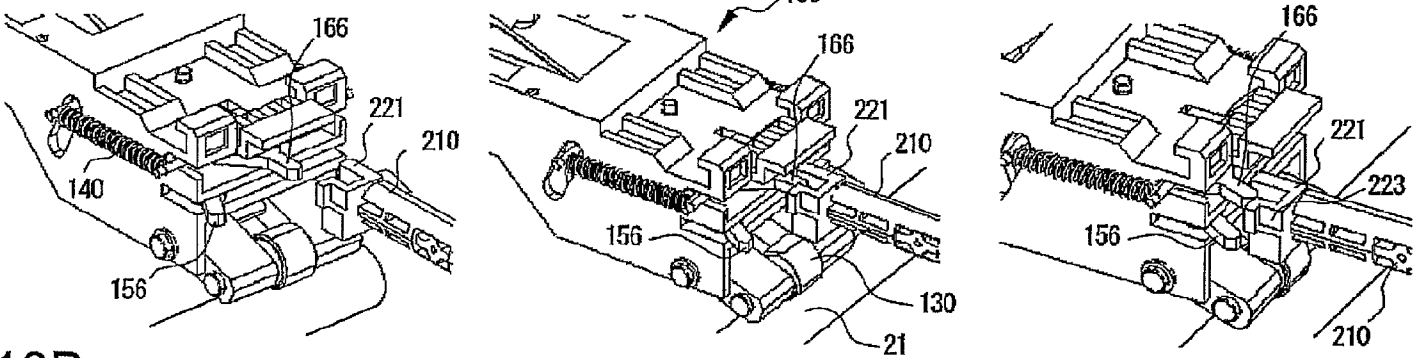
FIG. 10A is a perspective view and FIG. 10B is a plan view, similar to FIGS. 9A and 9B, but showing a case of switching and setting from the state with the ON state of clamping and the clamping pressure "medium" to the state with the clamping pressure "weak"
Figure 10B:
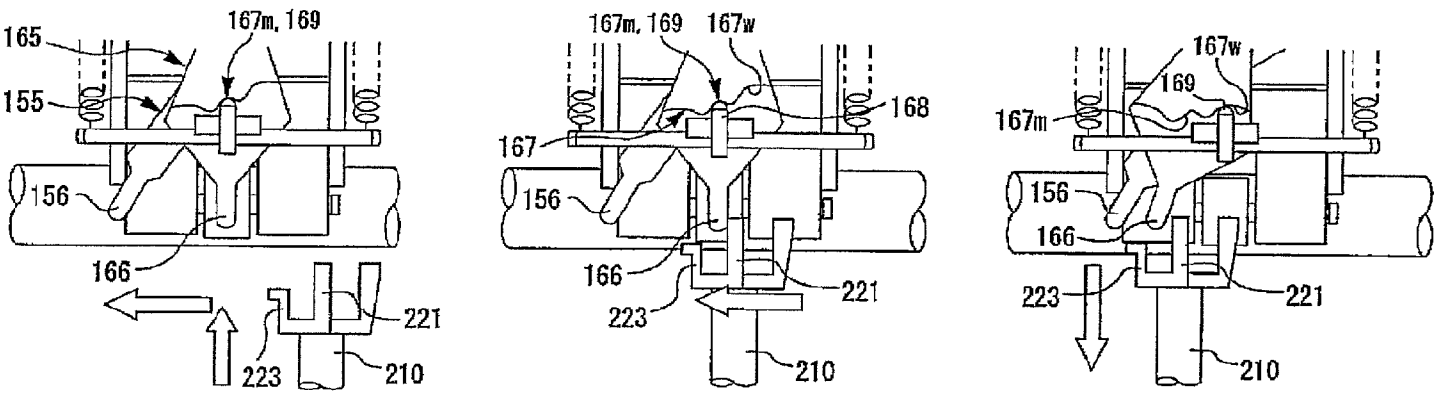

FIGS. 10A, 10B show actions of the slider 200 and the arm 210 for switching and setting from the state with the ON state of clamping and the clamping pressure "medium" to the state with the clamping pressure "weak" and show changes in positions of the clamp lever 155 and the clamping pressure setting lever 165 which are pivotally moved by the actions in chronological order (1), (2), (3), similarly to FIG. 9A, 9B. FIG. 10A is a perspective view thereof and FIG. 10B is a plan view thereof.

(1) In the state with the ON state of clamping and the clamping pressure "medium", the clamp lever 155 is positioned at the left end angular position as the ON position and the clamping pressure setting lever 165 is positioned at the middle as the medium position. The controller 90 moves the slider 200 to a position where the left wall of the first engaging finger 221 is positioned on the right side of the lever portion 166 positioned at the medium-position corresponding position and protracts the arm 210 to the engaging position. In this state, the controller 90 moves the slider 200 leftward.

(2) Then, the left wall of the first engaging finger 221 comes in contact with the lever portion 166 of the clamping pressure setting lever 165 and then pivotally moves the clamping pressure setting lever 165 leftward. As the clamping pressure setting lever 165 is pivotally moved leftward, the engaging convexity 169 fitted in the medium engaging concavity 167*m* gets over the boundary of the concavity and the cam slider 168 slides backward along the cam surface 167. When the slider 200 reaches the weak-position corresponding position, the engaging convexity 169 is fitted in the weak engaging concavity 167*w*. Though the third engaging finger 223 comes closer to the front of the lever portion 156 of the clamp lever 155, the engaging finger 223 does not interfere with the lever portion 156 because the third engaging finger 223 has a projecting size not to be contact with the lever portion 156 when the lever portion 156 is on the left or right side area on the pivotal movement trajectory of the clamp lever 155 as mentioned above.

(3) At the weak-position corresponding position, the arm 210 is moved to the retracting position. Therefore, the clamping pressure setting mechanism 160 is switched from "medium" to "weak" with keeping the clamp switch mechanism 150 in the clamping position so that the sheet-like medium (not shown) is clamped with a clamping pressure which is set at "weak".

Figure 11A:
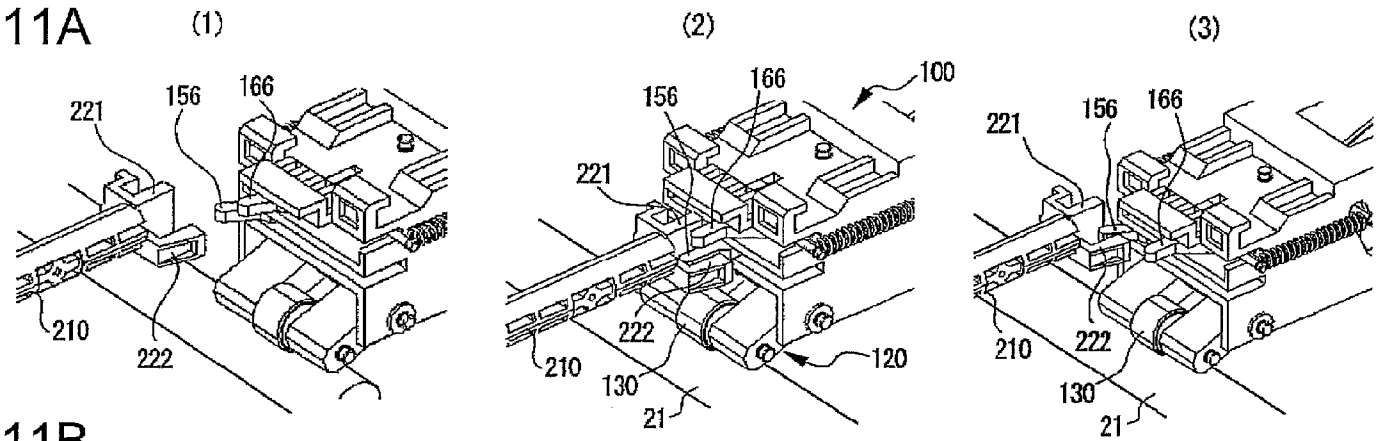
FIG. 11A is a perspective view and FIG. 11B is a plan view, similar to FIGS. 9A and 9B, but showing a case of switching and setting from the state with the ON state of clamping and the clamping pressure "weak" to the state with the clamping pressure "medium"
Figure 11B:
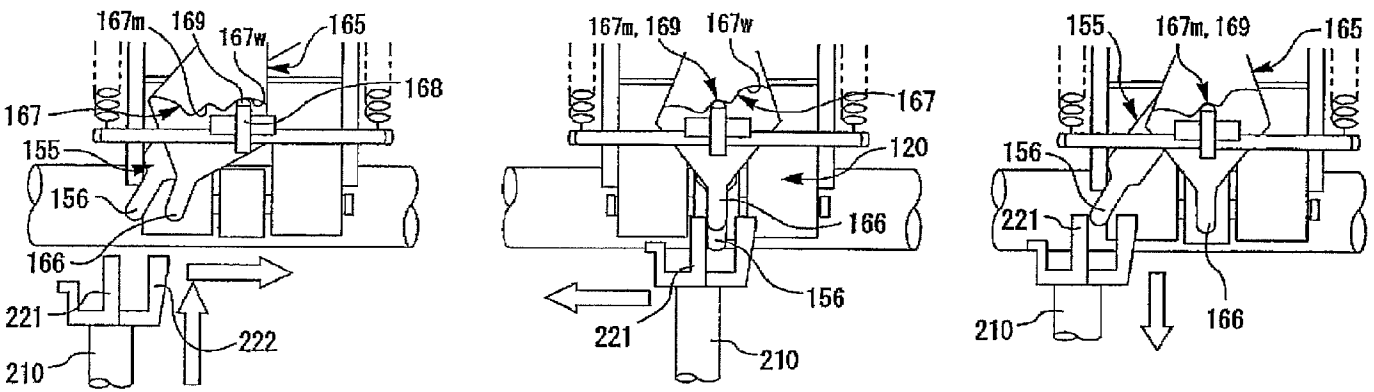

FIGS. 11A, 11B show actions the arm 210 for switching and setting from the reference state with the ON state of clamping and the clamping pressure "weak" to the state with the clamping pressure "medium" and show changes in positions of the clamp lever 155 and the clamping pressure setting lever 165 which are pivotally moved by the actions in chronological order (1), (2), (3), similarly to the above-cited drawings. FIG. 11A is a perspective view thereof and FIG. 11B is a plan view thereof.

(1) In the state with the ON state of clamping and the clamping pressure "weak", the clamp lever 155 and the clamping pressure setting lever 165 are both at the left end angular position. As mentioned above, the pivotal movement angles of the clamp lever 155 and the clamping pressure setting lever 165 are different from each other. The angular range from the weak position to the strong position of the clamping pressure setting lever 165 is smaller than the angular range from the OFF position to the ON position of the clamp lever 155. Accordingly, in the state with ON state of clamping and the clamping pressure "weak", the clamp lever 155 and the clamping pressure setting lever 165 are both positioned at the left end angular positions, but the lever portion 156 of the clamp lever 155 is on the left side of the lever portion 166 of the clamping pressure setting lever 165. On the other hand, the positions in the anteroposterior direction of the ends of the lever portions 156, 166 are substantially the same.

The controller 90 moves the slider 200 such that the right wall of the first engaging finger 221 is slightly on the left side of the lever portion 156 which is positioned at the ON position (that is, the lever portion 156 enters into a space between the first engaging finger 221 and the second engaging finger 222) and protracts the arm 210 to the engaging position. Then, the controller 90 moves the slider 200 rightward. Though, as seen from above, the second engaging finger 222 comes closer to the lever portion 166 of the clamping pressure setting lever 165, the second engaging finger 222 does not come in contact with the lever portion 166 of the clamping pressure setting lever because the second engaging finger 222 is formed at a lower portion to have a small height not to touch the lever portion 166 (see FIG. 8). Therefore, the second engaging finger 222 does not interfere with the lever portion 166 due to the protraction of the arm 210 and the rightward movement of the slider 200 so that the second engaging finger 222 passes below the lever 166.

(2) As the slider 200 is moved rightward, the right wall of the first engaging finger 221 first comes in contact with the lever portion 156 of the clamp lever 155 and then comes in contact with the lever portion 166 of the clamping pressure setting lever 165 so as to pivotally move both the levers 155, 165 rightward (in the counterclockwise direction). During this, the engaging convexity 169 fitted in the weak engaging concavity 167*w* gets over the boundary of the concavity and the cam slider 168 slides forward (toward the arm) along the cam surface 167. When the slider 200 reaches the medium-position corresponding position, the engaging convexity 169 is fitted into the medium engaging concavity 167*m* so that the clamping pressure setting lever 165 is held at the medium position. At this point, since the clamp lever 155 does not reach the ON/OFF switching angle, the clamp lever 155 is still biased leftward by the spring force of the coil springs 140 so that the lever portion 156 is in contact with the first engaging finger 221.

After moving the slider 200 to the medium-position corresponding position, the controller 90 moves the slider 200 leftward in the opposite direction. Then, the clamp lever 155 of which the lever portion 156 is supported by the first engaging finger 221 pivotally moves to the left end angular position as the ON position according to the leftward movement of the arm 210, whereby the pinch roller 130 returns to the clamping position where it is pressed against the feeding roller 21. The pivotal movement of the clamp base 120 is relatively slow at an angular velocity corresponding to the velocity of the leftward movement of the slider 200. That is, the pinch roller 130 slowly descends to be seated on the feeding roller. Though the pinch roller 130 rises in the processes (1) and (2), the movement of the rising is also slow so as to prevent the position of the sheet-like medium M on the platen from being shifted. Since the second engaging finger 222 does not come in contact with the lever portion 166 so as to pass below the lever portion 166, the clamping pressure setting lever 165 is not moved from the medium position to the weak position.

(3) As the slider 200 reaches the ON position of the clamp lever, the arm 210 is moved to the standby position. Accordingly, the clamp switch mechanism 150 is returned to the clamping position after it temporarily takes rising movement of slightly lifting the pinch roller 130 during the process of changing the clamping pressure. The clamping pressure setting mechanism 160 is switched from "weak" to "medium" so that the sheet-like medium is clamped with a clamping pressure set to "medium".

Figure 12A:
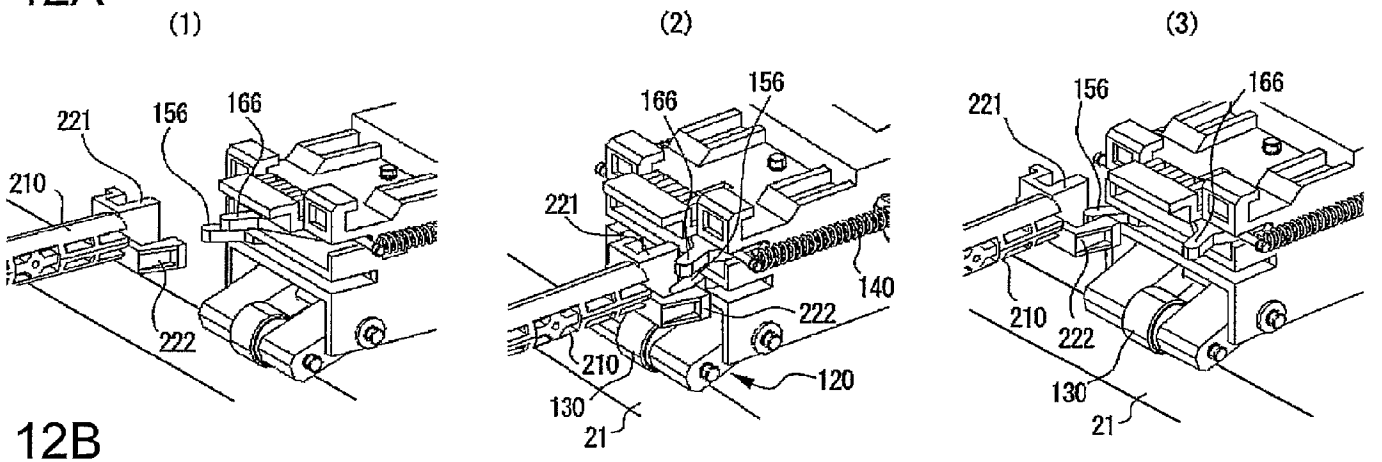
FIG. 12A is a perspective view and FIG. 12B is a plan view, similar to FIGS. 9A and 9B, but showing a case of switching and setting from the state with the ON state of clamping and the clamping pressure "weak" to the state with the clamping pressure "strong"
Figure 12B:
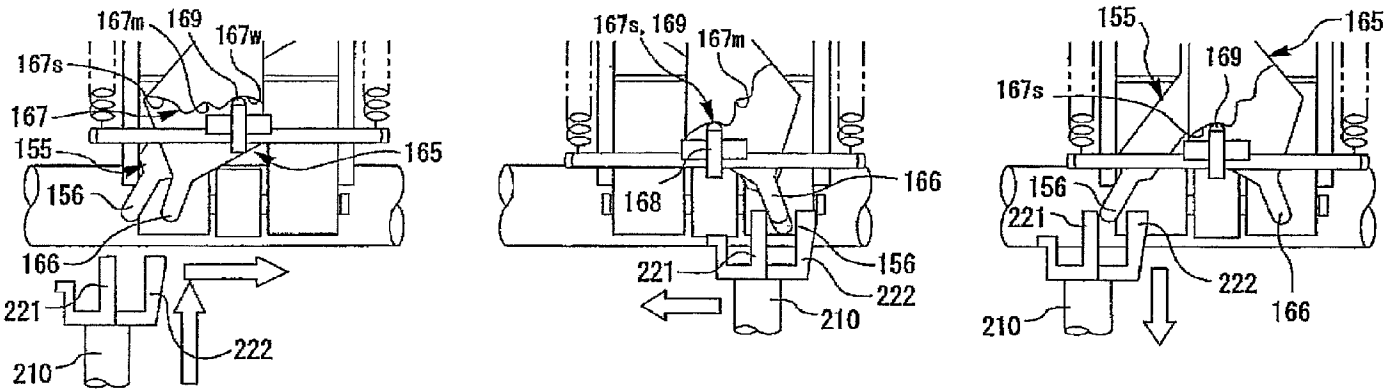

FIGS. 12A, 12B show actions the arm 210 for switching and setting from the reference state with the ON state of clamping and the clamping pressure "weak" to the state with the clamping pressure "strong" and show changes in positions of the clamp lever 155 and the clamping pressure setting lever 165 which are pivotally moved by the actions in chronological order (1), (2), (3), similarly to the above-cited drawings. FIG. 12A is a perspective view thereof and FIG. 12B is a plan view thereof.

(1) In the state with the ON state of clamping and the clamping pressure "weak", the clamp lever 155 and the clamping pressure setting lever 165 are both at the left end angular position similarly to the aforementioned description made with reference to FIGS. 11A, 11B. The controller 90 moves the slider 200 such that the lever portion 156 enters into a space between the first engaging finger 221 and the second engaging finger 222 and protracts the arm 210 to the engaging position. Then, the controller 90 moves the slider 200 rightward. During this, the second engaging finger 222 does not interfere with the lever portion 166 so that the second engaging finger 222 passes below the lever 166.

(2) As the slider 200 is moved rightward, the right wall of the first engaging finger 221 first comes in contact with the lever portion 156 of the clamp lever 155 and then comes in contact with the lever portion 166 of the clamping pressure setting lever 165 so as to pivotally move both the levers 155, 165 rightward. By this pivotal movement, the engaging convexity 169 fitted in the weak engaging concavity 167*w* gets over the boundary of the concavity so that the engaging convexity 169 slides forward along the cam surface 167 and the engaging convexity 169 further gets over the boundary of the medium engaging concavity 167*m*. When the slider 200 reaches the strong-position corresponding position, the engaging convexity 169 is fitted into the strong engaging concavity 167*s* so that the clamping pressure setting lever 165 is held at the strong position. At this point, the clamp lever 155 is close to the ON/OFF switching angle, as concretely speaking, the left end corner 157*p* of the OFF contact face 157*f* in the clamp lever 155 is positioned on the normal line extending from the lever shaft 115 to the lever engaging portion 122 (see FIG. 6).

After moving the slider 200 to the strong-position corresponding position, the controller 90 moves the slider 200 leftward in the opposite direction. Then, even though the clamp lever 155 is on neutral position because of the engagement between an arc-like R portion of the left end corner 157*p* of the OFF contact face 157*f* and the lever engaging portion 122 and is biased neither in the ON direction nor the OFF direction (moreover even though the clamp lever 155 is biased in the OFF direction), the lever portion 156 is pressed to move leftward by the third engaging finger 223 which is moving leftward, whereby the lever portion 156 becomes to a state supported by the first engaging finger 221 and is thus pivotally moved to the ON position according to the leftward movement of the arm 210 so as to return to the clamping position. The pivotal movement of the clamp base 120 is relatively slow as mentioned above. That is, the pinch roller 130 slowly descends to be seated on the feeding roller. Though the pinch roller 130 rises in this process, the movement of the rising is also slow so as to prevent the position of the sheet-like medium M on the platen from being shifted. Since the second engaging finger 222 does not come in contact with the lever portion 166 so as to pass below the lever portion 166, the clamping pressure setting lever 165 is not moved from the strong position to the weak position.

(3) As the slider 200 reaches the ON position of the clamp lever, the arm 210 is moved to the standby position. Accordingly, the clamp switch mechanism 150 is returned to the clamping position after it temporarily takes rising movement of slightly lifting the pinch roller 130 during the process of changing the clamping pressure. The clamping pressure setting mechanism 160 is switched from "weak" to "strong" so that the sheet-like medium is clamped with a clamping pressure set to "strong".

Figure 13A:
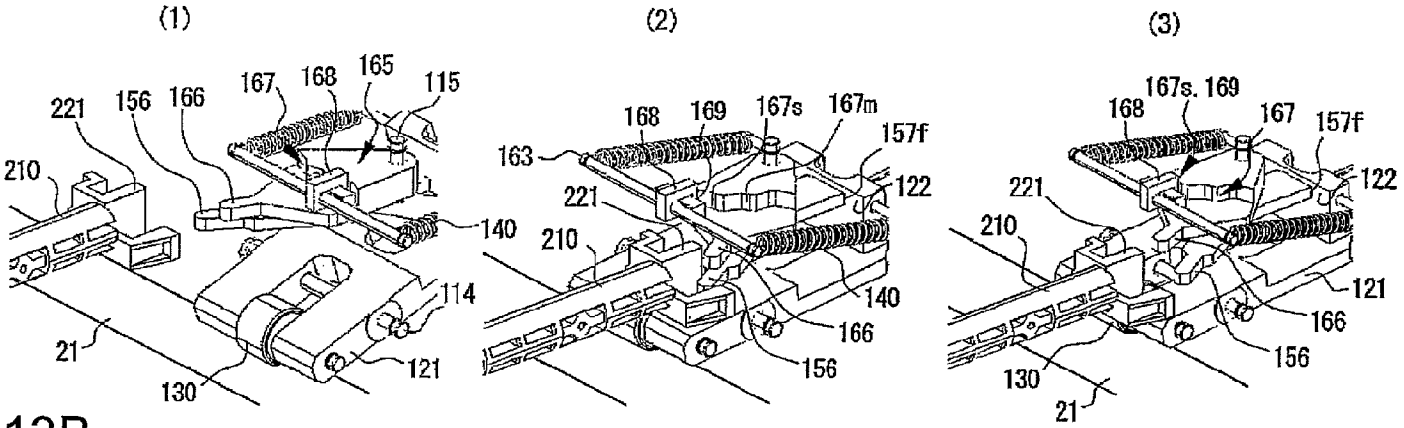
FIG. 13A is a perspective view and FIG. 13B is a plan view, similar to FIGS. 9A and 9B, but showing a case of switching and setting from the state with the ON state of clamping and the clamping pressure "weak" to the state with the OFF state of clamping and the clamping pressure "strong".
Figure 13B:
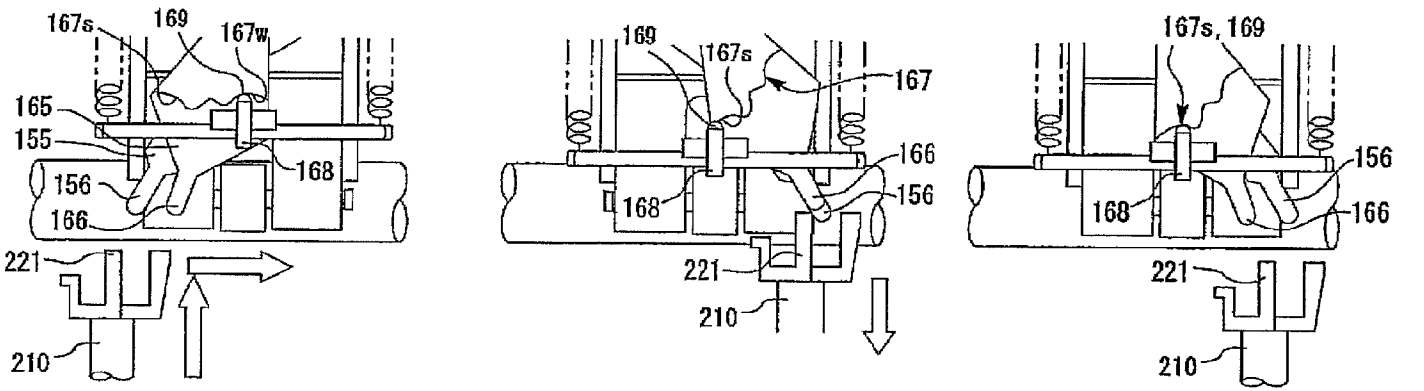

FIGS. 13A, 13B show actions of the slider 200 and the arm 210 for switching and setting from the reference state with the ON state of clamping and the clamping pressure "weak" to the state with the OFF state of clamping and the clamping pressure "strong" and show changes in positions of the clamp lever 155 and the clamping pressure setting lever 165 which are pivotally moved by the actions in chronological order (1), (2), (3), similarly to the above-cited drawings. FIG. 13A is a perspective view thereof and FIG. 13B is a plan view thereof.

In this switching, the approach of the arm 210 and the rightward movement of the levers 155 and 165 shown in (1) are the same as the case shown in FIGS. 12A, 12B. However, in this switching operation, (2) the slider 200 is moved to the OFF position passing over the strong-position corresponding position (contrast (2) of FIG. 12B and (2) of FIG. 13B). That is, even when the clamp lever 155 is on neutral position as mentioned above, the levers 155, 165 are pivotally moved rightward such that the clamp lever 155 passes over the ON/OFF switching angle so as to securely reach the OFF position (to the state as shown in FIG. 6A where the OFF contact face 157*f* is in contact with the lever contact face 122). During this, in the clamping pressure setting mechanism 160, the engaging convexity 169 of the cam slider 168 passes over the center of the concavity of the strong engaging concavity 167*s* to run on the opposite-side slope and keeps the contact state without coming off the cam surface 167.

(3) As the slider 200 reaches the OFF position of the clamp lever, the arm 210 is moved to the standby position. Accordingly, the clamp switch mechanism 150 is set to the unclamping position (the OFF state of clamping) where the pinch roller 130 is upwardly spaced apart from the feeding roller 21 and the clamping pressure setting mechanism 160 is switched from "weak" to "strong" so that the roller assembly 100 is set to the standby state with the OFF state of clamping and the clamping pressure "strong".

By using a combination of the five basic operations shown in FIGS. 9A, 9B through FIGS. 13A, 13B as mentioned above, all of operations for switching the ON/OFF of the clamping in the clamp switch mechanism 150 and the clamping pressure weak/medium/strong in the clamping pressure setting mechanism 160 can be conducted. Therefore, the state of clamping can be finely adjusted according to the material, the shape, and the size of the sheet-like medium as the subject to be processed just by loading a process program without the need for manipulating the respective levers of all of the roller assemblies by an operator.

Though the arrangement in which the slider 200 is provided with the arm 210 which is movable in the anteroposterior direction has been described in the aforementioned embodiment, the arm 210 may be any form which is movable between the engaging position where the arm 210 is in contact with the levers 155, 165 to pivotally move the levers and the standby position where the arm 210 is not in contact with the levers 155, 165 so as to pass through the levers 155, 165 when the slider 200 is moved in the lateral direction along the guide rail. For example, such an arrangement may be employed that a proximal end portion of the arm 210 is pivotally fixed to the slider 200 such that a distal end portion (engaging hand 220) is pivotally movable in the vertical direction. Further, such an arrangement capable of moving the arm 210 up and down in the vertical direction may be employed.

In the embodiment, the end of the arm 210 has the first through third engaging fingers 221 through 223 for achieving both the switching of the setting of the clamp switch mechanism 150 and the switching of the setting of the clamping pressure setting mechanism 160 by the single arm having a simple structure. However, the present invention is not limited to the embodiment as mentioned above, for example, a plurality of arms corresponding to the respective setting mechanisms may be disposed on the slider 200 such that the arms can be driven independently from one another. In this case, the state of clamping is changed by operating one or more of the arms according to the condition.

In the aforementioned description, the printer-plotter having both the cutting plotter 50 and the printer 60 in which the arm 210 is disposed on the slider 200 connecting the cutting head 50 and the printer head 60 has been described. However, the present invention may be applied to a printer or a plotter having either a printer head or a cutting head. In this case, a slider with a function of changing the state of clamping may be provided or the function as such a slider may be incorporated into the printer head or the cutting head.

In the embodiments according to the present invention, each roller assembly which is disposed above the feeding roller is provided with a lever capable of changing the state of clamping the sheet-like medium according to the angular position in the lateral direction thereof, the slider supported by the guide rail has the arm which can be displaced between an engaging position where the arm is engaged with the lever to pivotally move the lever when the slider is moved in the lateral direction along the guide rail and a standby position where the arm is not engaged with the lever so as to pass through the lever when the slider is moved in the lateral direction along the guide rail. The state of clamping the sheet-like medium by the roller assembly is allowed to be changed by displacing the arm between the engaging position and the standby position while moving the slider along the guide rail so as to change the angular positions of the lever. Therefore, the embodiments of the present invention provides a printer/ plotter achieving both the fine adjustment of the state of clamping according to the material and the shape of the sheet-like medium and good operability, with a simple structure preventing increase in size and complex of the apparatus, and without requiring operation by an operator to move the lever to change the state of clamping for every subject to be processed.

As for the change of the state of clamping, the arrangement capable of switching the state of clamping by the pinch roller between the ON state and the OFF state can obtain the aforementioned effects without the need for complex operation such as manually operating the clamp lever of each of the roller assemblies and the arrangement capable of adjusting the pressing force (clamping pressure) of the pinch roller can obtain the aforementioned effects without the need for the complex operation such as manual operation of the clamping pressure setting lever of every roller assembly.

According to the embodiments including a clamp switch mechanism including a first lever and a second lever which are aligned in the vertical direction and are pivotally movable in the lateral direction, wherein the angular position of the first lever can be changed between a clamping position and an unclamping position with the predetermined clamp angle as the boundary therebetween, and a clamping pressure setting mechanism capable of changing and setting the pressing pressure according to the angular position of the second lever within an angular range larger than the clamping angle, wherein by displacing the arm between the engaging position and the standby position while moving the arm in the lateral direction, the angular positions of the first lever and the second lever are changed so as to change the state of clamping between the ON state and the OFF state and the clamping pressure, embodiments of the present invention provides a printer/plotter achieving both the fine adjustment of the state of clamping according to the material and the shape of the sheet-like medium and good operability, with a simple structure including small-size roller assemblies and a single arm.

According to the embodiments including a clamp switch mechanism including a first lever and a second lever which are aligned in the vertical direction and are pivotally movable in the lateral direction, wherein the clamp switch mechanism can be switched between a clamping position and an unclamping position according to angular position of the first lever, and a clamping pressure setting mechanism capable of changing and setting the pressing pressure according to the angular position of the second lever, wherein the arm has a first engaging finger which is engaged with at least one of the first lever and the second lever and a second engaging finger which is engaged with the other one of the first lever and the second lever when the arm is set at the engaging position and the slider moved in the lateral direction, and wherein according to a combination among the moving direction of the arm, the position of the arm (the engaging position or the standby position), and the selection of the engaging fingers to be engaged (the first engaging finger and/or the second engaging finger), the angular positions of the first lever and the second lever are changed so as to change the state of clamping between the ON state and the OFF state and the clamping pressure, the embodiments of the present invention provides a printer/plotter achieving both the fine adjustment (for example, the clamping pressure can be selected from plural stages such as three stages or more or the clamping pressure can be adjusted in stepless form) of the state of clamping according to the material and the shape of the sheet-like medium and good operability, with a simple structure including small-size roller assemblies and a single arm.

According to the embodiment that the guide rail by which the slider is supported is a rail member on which a head for conducting a predetermined action relative to the sheet-like medium is disposed, that is, that the slider is supported by the guide rail on which a printer head and/or a cutting head is disposed, the embodiments of the present invention provides a printer/plotter capable of obtaining the aforementioned effects with a simple structure preventing the increase in complex of mechanical structure.

According to the embodiments that the head includes a printer head and a cutting head and that the slider is a connecting member for connecting the printer head and the cutting head, the embodiments of the present invention provides a printer/plotter capable of obtaining the aforementioned effects with a simple structure in which the arm and its driving mechanism are disposed on the connecting member for connecting the printer head and the cutting head in the printer/plotter of a type having the printer had and the cutting head. It should be noted that the connecting member may be disposed separately from the printer head and the cutting head, and may be attached to either of the printer head or the cutting head.

Therefore, according to the embodiments of the present invention, a printer or the like capable of changing the state of clamping a sheet-like medium corresponding to a variety of subjects to be processed with simple structure and without the need for complex operation is provided.

Obviously, numerous modifications and variations of the present invention are possible in light of the above teachings. It is therefore to be understood that within the scope of the appended claims, the invention may be practiced otherwise than as specifically described herein.

What is claimed as new and is desired to be secured by Letters Patent of the United States is:

1. A medium transport apparatus comprising:

a feeding roller configured to rotate around a rotational axis;

a guide rail extending along the rotational axis;

a slider supported by the guide rail and movable along the rotational axis;

a rotatable pinch roller configured to clamp medium between the feeding roller and the pinch roller to move the medium;

a lever connected to the pinch roller and movable to change a clamping state with respect to the medium between the feeding roller and the pinch roller; and an arm connected to the slider and configured to take an engaging position where the arm moves the lever to change the clamping state when the slider moves along the rotational axis and a standby position where the arm is not engaged with the lever when the slider moves along the rotational axis.

2. The medium transport apparatus according to claim 1, wherein the clamping state comprises a clamping position in which the pinch roller is pressed against the feeding roller to clamp the medium between the feeding roller and the pinch roller, and an unclamping position in which the pinch roller is separated from the feeding roller.

3. The medium transport apparatus according to claim 1, wherein the clamping state comprises a strength of pressing force applied by the pinch roller against the feeding roller.

4. The medium transport apparatus according to claim 1, wherein the lever comprises a first lever pivotally movable, and a second lever pivotally movable, wherein the medium transport apparatus comprises a clamp switch mechanism configured to switch the clamping state between a clamping position where the pinch roller is pressed against the feeding roller to clamp the medium when an angular position of the first lever pivotally moved by the arm is larger than a predetermined clamping angle and an unclamping position where the pinch roller is separated from the feeding roller when the angular position of the first lever is smaller than the predetermined clamping angle; and a clamping pressure setting mechanism configured to change a strength of pressing force applied by the pinch roller against the feeding roller according to an angular position of the second lever within an angular range larger than the predetermined clamping angle, and wherein by displacing said arm between said engaging position and said standby position while moving said slider along said guide rail, the angular positions of said first lever and said second lever are changed so as to change the state of clamping said sheet-like medium and the pressing force of said pinch roller by said roller assembly.

5. The medium transport apparatus according to claim 1, wherein the lever comprises a first lever pivotally movable, and a second lever pivotally movable, wherein the medium transport apparatus comprises a clamp switch mechanism configured to switch the clamping state between a clamping position where the pinch roller is pressed against the feeding roller to clamp the medium and an unclamping position where the pinch roller is separated from the feeding roller according to an angular position of the first lever; and a clamping pressure setting mechanism configured to change a strength of pressing force applied by the pinch roller against the feeding roller according to an angular position of the second lever, wherein the arm comprises a first engaging finger engageable with at least one of the first lever and the second lever, and a second engaging finger engageable with another of the first lever and the second lever when the arm is set at the engaging position and the slider is moved along the rotational axis, and wherein the angular positions of the first lever and the second lever are changed by the first engaging finger and the second engaging finger so as to change the clamping state by moving the arm together with the slider between the engaging position and the standby position.

6. The medium transport apparatus according to claim 1, wherein the clamping state is changed by displacing the arm between the engaging position and the standby position while the slider moves along the guide rail so as to set the angular positions of said lever.

7. A printer comprising:

a medium transport apparatus comprising:

a feeding roller configured to rotate around a rotational axis;

a guide rail extending along the rotational axis;

a slider supported by the guide rail and movable along the rotational axis;

a rotatable pinch roller configured to clamp medium between the feeding roller and the pinch roller to move the medium;

a lever connected to the pinch roller and movable to change a clamping state with respect to the medium between the feeding roller and the pinch roller; and an arm connected to the slider and configured to take an engaging position where the arm moves the lever to change the clamping state when the slider moves along the rotational axis and a standby position where the arm is not engaged with the lever when the slider moves along the rotational axis.

8. The printer according to claim 7, wherein the printer comprises a printer head supported by the guide rail and movable along the rotational axis, and a connecting device configured to connect the printer head to the slider.

9. A plotter comprising:

a medium transport apparatus comprising:

a feeding roller configured to rotate around a rotational axis;

a guide rail extending along the rotational axis;

a slider supported by the guide rail and movable along the rotational axis;

a rotatable pinch roller configured to clamp medium between the feeding roller and the pinch roller to move the medium;

a lever connected to the pinch roller and movable to change a clamping state with respect to the medium between the feeding roller and the pinch roller; and an arm connected to the slider and configured to take an engaging position where the arm moves the lever to change the clamping state when the slider moves along the rotational axis and a standby position where the arm is not engaged with the lever when the slider moves along the rotational axis.

10. The plotter according to claim 9, wherein the plotter comprises a cutting head supported by the guide rail and movable along the rotational axis, and a connecting device configured to connect the cutting head to the slider.

11. A combination of a printer and a plotter, comprising:

a medium transport apparatus comprising:

a feeding roller configured to rotate around a rotational axis;

a guide rail extending along the rotational axis;

a slider supported by the guide rail and movable along the rotational axis;

a rotatable pinch roller configured to clamp medium between the feeding roller and the pinch roller to move the medium;

a lever connected to the pinch roller and movable to change a clamping state with respect to the medium between the feeding roller and the pinch roller; and an arm connected to the slider and configured to take an engaging position where the arm moves the lever to change the clamping state when the slider moves along the rotational axis and a standby position where the arm is not engaged with the lever when the slider moves along the rotational axis.

12. The combination according to claim 11, wherein the combination comprises a printer head supported by the guide rail on one side with respect to the slider and movable along the rotational axis, a cutting head supported by the guide rail on another side with respect to the slider and movable along the rotational axis, the slider being configured to be connected to at least one of the printer head and the cutting head.

13. A medium transport apparatus comprising:

feeding means for rotating around a rotational axis;

guide means extending along the rotational axis for guiding;

sliding means for sliding on the guide means along the rotational axis;

rotatable pinch means for clamping medium between the feeding means and the pinch means to move the medium;

lever means for changing the clamping state with respect to the medium between the feeding means and the pinch means; and arm means for moving the lever means to change the clamping state when the sliding means moves along the rotational axis in an engaging position and for not engaging with the lever means when the sliding means moves along the rotational axis in a standby position.

* * * * *